US010577828B2

(12) United States Patent
Hedley

(10) Patent No.: US 10,577,828 B2
(45) Date of Patent: Mar. 3, 2020

(54) METHOD AND COMPONENTS FOR FENCE/POST INSTALLATION

(71) Applicant: Justoy Pty Limited, Mount Thorley, NSW (AU)

(72) Inventor: Robert Ian Hedley, Buttaba (AU)

(73) Assignee: Justoy Pty Limited, Mount Thorley, NSW (AU)

( * ) Notice: Subject to any disclaimer, the term of this patent is extended or adjusted under 35 U.S.C. 154(b) by 306 days.

(21) Appl. No.: 15/502,154

(22) PCT Filed: Aug. 18, 2015

(86) PCT No.: PCT/AU2015/050472

§ 371 (c)(1),
(2) Date: Feb. 6, 2017

(87) PCT Pub. No.: WO2016/025999

PCT Pub. Date: Feb. 25, 2016

(65) Prior Publication Data

US 2017/0218657 A1 Aug. 3, 2017

(30) Foreign Application Priority Data

Aug. 18, 2014 (AU) ..... 2014903219

(51) Int. Cl.

| | |
|---|---|
| ***E04H 12/22*** | (2006.01) |
| ***E04H 17/26*** | (2006.01) |
| ***E02D 7/06*** | (2006.01) |
| ***E04H 12/34*** | (2006.01) |
| ***E04H 17/06*** | (2006.01) |

(Continued)

(52) U.S. Cl.
CPC ..... *E04H 17/263* (2013.01); *E02D 7/06* (2013.01); *E04H 12/2215* (2013.01); *E04H 12/347* (2013.01); *E04H 17/06* (2013.01); *E04H 17/12* (2013.01); *E04H 17/22* (2013.01)

(58) Field of Classification Search
CPC .... E04H 17/22; E04H 12/2215; E04H 12/223
USPC ..... 256/65.14
See application file for complete search history.

(56) References Cited

U.S. PATENT DOCUMENTS 373,621 A * 11/1887 Turnberger ..... E02D 5/80 52/156
529,067 A * 11/1894 Fraser ..... E04H 12/2215 256/24

(Continued)

FOREIGN PATENT DOCUMENTS

| | | |
|---|---|---|
| CH | 675893 A5 | 9/1990 |
| EP | 1743992 A2 | 1/2007 |

(Continued)

OTHER PUBLICATIONS

International Search Report corresponding to PCT/AU2015/050472, dated Nov. 23, 2015, five pages.

*Primary Examiner* — Joshua T Kennedy
(74) *Attorney, Agent, or Firm* — Kilpatrick Townsend & Stockton LLP

(57) ABSTRACT

A post mount (1), adapted to be installed in a substrate and releasably receive a post therein, including: a body (2); and an insert (3), adapted to cooperate with the body; wherein, in use, the body is adapted to be driven into the substrate, and, thereafter, the insert is adapted to be at least partially deformed, to thereby anchor the post mount to the substrate.

7 Claims, 45 Drawing Sheets

(51) Int. Cl.
*E04H 17/12* (2006.01)
*E04H 17/22* (2006.01)

(56) References Cited

U.S. PATENT DOCUMENTS 697,031 A * 4/1902 Snook ..... E02D 5/803 256/52
958,127 A 5/1920 Hobrud
2,025,556 A 12/1935 Stahl
2,588,712 A * 3/1952 Ferris ..... E02D 5/805 52/161
3,526,069 A * 9/1970 Deike ..... E02D 5/805 405/244
3,676,965 A * 7/1972 Deike ..... E02D 5/801 52/98
3,772,838 A * 11/1973 Virnig ..... E02D 5/805 52/160
3,861,247 A 1/1975 Gerschwiller
4,086,735 A * 5/1978 Adams ..... E02D 5/805 405/259.1
4,813,816 A * 3/1989 Simanjuntak ..... E02D 5/44 405/232
4,889,451 A * 12/1989 Simanjuntak ..... E02D 5/44 405/244
4,911,394 A 3/1990 Ericson
7,883,070 B2 * 2/2011 Schroeder ..... E04H 12/2215 248/156
8,096,368 B1 * 1/2012 Rider ..... E04H 17/263 173/1
9,394,663 B2 * 7/2016 Berger ..... E04H 12/2215
2010/0037554 A1 2/2010 Oh

FOREIGN PATENT DOCUMENTS

FR 856533 A 6/1940
FR 2615230 A1 11/1988
NL 7909360 A 7/1981

* cited by examiner

METHOD AND COMPONENTS FOR FENCE/POST INSTALLATION

TECHNICAL FIELD

The present invention generally relates to fence posts and in particular to an improved method and components for the installation of fence posts.

BACKGROUND

Fence posts are extensively used in farming and many other areas. They are often subjected to significant stresses, such as from extreme weather events, impact by animals, and forces due to the operation of gates. As a result, replacement and repair is a common and often constant process. Therefore, easy and strong installation of sturdy fence posts has the potential to provide significant financial benefits.

Prior art fence posts are typically single piece items buried a significant distance into the ground to provide the required strength. This may be achieved by driving the post directly into the ground, or by drilling or digging a hole first and then filling around the post after it has been installed. Requiring such a large depth can cause difficulties in digging and problems such as interference or damage to utilities located below the ground in the vicinity of the fence post location.

The reference in this specification to any prior publication (or information derived from it), or to any matter which is known, is not, and should not be taken as, an acknowledgement or admission or any form of suggestion that prior publication (or information derived from it) or known matter forms part of the common general knowledge in the field of endeavour to which this specification relates.

BRIEF SUMMARY

The present invention seeks to provide a method and components for installing fence posts which overcome some of the drawbacks of the prior art.

According to one example aspect, there is provided a post mount, adapted to be installed in a substrate and releasably receive a post therein.

In another form, the post mount includes a body and an insert adapted to cooperate with the body, wherein, in use, the body is adapted to be driven into the substrate, and, thereafter, the insert is adapted to be at least partially deformed, to thereby anchor the post mount to the substrate.

In another form, the body includes at least one guide which is adapted to cooperate with and deform a deforming portion of the insert.

In another form, the at least one guide is shaped so that the deforming portion of the insert is adapted to be outwardly displaced.

In another form, the post mount includes an opening at an upper end of the post mount adapted to receive a post therein.

In another form, a lower end of the body is shaped to facilitate driving the post mount into the substrate.

In another form, an upper end of the post mount is adapted to receive a tool, to drive the post mount into the substrate.

In another form, the tool is adapted to deform the insert to thereby anchor the post mount to the substrate.

In another form, the body includes a plurality of plate members, each plate member including a cutting edge at a lower end thereof, adapted to penetrate the substrate, an insert receiving portion at an upper end thereof adapted to receive the insert, and an orifice, intermediate the ends thereof, which acts as the guide, into which a deformable portion of the insert is adapted to be driven and be outwardly splayed.

In another form, the body further includes a flange, which is adapted to abut a substrate surface, from which each of the plurality of plates depend.

In another form, the slit is substantially outwardly curved in shape.

In another form, the insert includes a plurality of walls, adapted to be substantially received within the body, and adapted to receive the post in an upper part thereof.

According to another example aspect, there is provided a post assembly, including a post mount, adapted to be installed in a substrate, and a post, adapted to be releasably received in the post mount.

In another form, the post assembly includes a post mount substantially as herein described.

According to another example aspect, there is provided a fence, including a plurality of post assemblies substantially as herein described and fencing material spanning each of the post assemblies.

According to another example aspect, there is provided a method of installing a post mount, the post mount being adapted to releasably receive a post therein, including driving the post mount into a substrate.

In another form, the post mount is substantially as herein described.

In another form, the method includes driving the body into the substrate, and deforming the deformable portion of the insert to thereby anchor the post mount in the substrate.

According to another example aspect, there is provided a tool for installing a post mount in a substrate, wherein the post mount is substantially as herein described.

In another form, the tool is adapted to couple with the post mount and transmit force applied to an impact end of the tool to the post mount.

In another form, the tool is adapted to selectively drive the insert relative to the body and thereby cause the deformable portion of the insert to be splayed.

In another form, the tool includes a moveable outer collar that has a first position that allows the tool to be in contact with the body of the post mount and a second position that allows the collar to contact the insert of the post mount.

In another form, the collar is locked into either of the first or second positions using a pin inserted through holes in the collar and a body of the tool.

In another form, the tool has a groove at a driving end configured to couple with the post mount when the collar is in the first position.

In another form, the driving end is tapered.

According to another example aspect, there is provided a post assembly, including a post mount substantially as herein described and a post adapted to be releasably attached to the post mount, wherein the post mount is installed in a substrate using a tool substantially as herein described.

According to another example aspect, there is provided a brace for supporting a post, including a first end configured to attach to a post, a second end configured to abut a substrate surface and a tether that can be tensioned to provide an adjusting means.

In another form, the tether attaches to the post proximal to the substrate surface, the brace attaches to the post at a point removed from the substrate surface, and the tether attaches to the brace at a location removed from the post.

In another form, a connection between the tether and the brace includes a flat plate that abuts the substrate surface.

In another form, the connection includes a ratchet to adjust the length of the tether relative to the brace.

According to another example aspect, there is provided a post with a plurality of attachment points that allow items including gates, braces and/or fences to be attached, wherein the attachment points allow repeated attachment and removal of items.

In another form, the attachment points provide multiple options for attachment position.

In another form, each attachment point is a pair of vertical slots.

In another form, the post includes four outer faces substantially normal to one another, wherein attachment points may be a pair of slots on the same face or a pair of slots on adjacent faces.

In another form, each face includes one or more pairs of vertical slots horizontally aligned with a pair of slots on at least one adjacent wall, such that attachment points may share a vertical slot and a connecting bracket can be attached to the post using a pair of slots on one face or a corner connecting bracket can be attached to a slot on one face and a slot on an adjacent face.

In another form, side walls of the slots are angled at 45° to the face of the post, such that the side walls of slots on either side of a corner of the post are parallel to one another.

According to another example aspect, there is provided a gate assembly, including a post and a plurality of brackets for supporting a gate, wherein the bracket is substantially U shaped and connects to the post by being inserted into slots in the post and is held in place by tabs on the bracket.

In another form, the gate assembly further includes a spigot that attaches to one of the brackets and onto which a gate can be fitted.

In another form, the brackets attach to the post without the use of bolts or other fasteners.

According to another example aspect, there is provided a machine that drives and anchors at least one post mount into a substrate.

In another form, the machine includes a vehicle which uses a positioning system such as GPS to locate and position each post mount.

In another form, the post mount is substantially as herein described.

According to another example aspect, there is provided a wire joiner, including a main body with two bores passing through and a plurality of wedge shaped inserts, wherein two wires can be joined by threading one wire through each bore and fixing in place by forcing the inserts into the bores beside the wires.

In another form, the inserts are arranged in the main body such that placing tension on the wires acts to force the inserts further into the main body, thereby strengthening the hold of the wire joiner on the wires.

According to another example aspect, there is provided a system for connecting a wire to a post, including a connector and a post, wherein the connector is configured to retain the wire and to couple with the post. In another form, the connector retains the wire using a gripping device.

In another form, the connector includes a hook and the post includes two holes, wherein the post is configured to couple to the connector by receiving the hook in one of the holes.

In another form, the connector includes a second hook oriented in an opposing direction to the first hook, such that the post couples with the connector by receiving one of the hooks in each of the holes.

In another form, both of the hooks are positioned behind a portion of the post located between the holes when the post is coupled to the connector.

According to another example aspect, there is provided a method of connecting a wire to a post, using a connector configured to connect to the wire and including two hooks facing in substantially opposing directions, the post including two holes configured to receive the hooks, the method including the steps of inserting the hooks into the holes; and rotating the connector so that the hooks are positioned to latch to the post.

In another form, the connector uses a gripping device to connect to the wire, and the method includes the step of inserting the wire into the connector.

In another form, the hooks are each inserted into a different one of the holes, and wherein when applying tension to the wire after the hooks are latched to the post each hook enters into one of the holes and at least partially exits from the other of the holes.

According to another example aspect, there is provided a post mount, adapted to be installed in a substrate and receive a post therein, wherein, in use, the post mount is adapted to be driven into the substrate, and, thereafter, the post is adapted to be inserted into the post mount and at least partially deformed, to thereby anchor the post mount to the substrate.

In another form, the post mount includes at least one guide which is adapted to cooperate with and deform a deforming portion of the post. In yet another form, the at least one guide is shaped so that the deforming portion of the post is adapted to be outwardly displaced

BRIEF DESCRIPTION OF FIGURES

Example embodiments should become apparent from the following description, which is given by way of example only, of at least one preferred but non-limiting embodiment, described in connection with the accompanying figures, in which.

PREFERRED EMBODIMENTS

Figure 1:
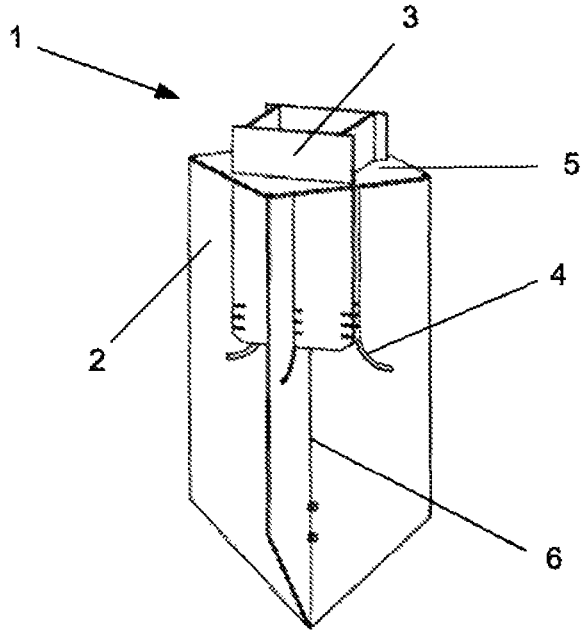
FIG. 1 illustrates a preferred embodiment of a post mount.

The following modes, given by way of example only, are described in order to provide a more precise understanding of the subject matter of a preferred embodiment or embodiments.

In the figures, incorporated to illustrate features of an example embodiment, like reference numerals are used to identify like parts throughout the figures.

Referring to FIG. 1, a preferred embodiment of a post mount is shown. The post mount, generally referred to by the reference numeral 1, includes a body 2 and an insert 3. The body 2 includes curved slots 4 that act as a guide along which the insert 3 can be forced. The body 2 also includes a flange 5 near the top of the post mount 1. The plates that form the body 2 are substantially normal to one another in the preferred embodiment, and, intersect at a lower portion 6.

Throughout this description the term post may refer to any structural item typically installed in the ground or substrate, such as but not limited to a post for supporting a fence or gate, a bollard, an anchor, or, a column or other structural component of a building etc.

Figure 2:
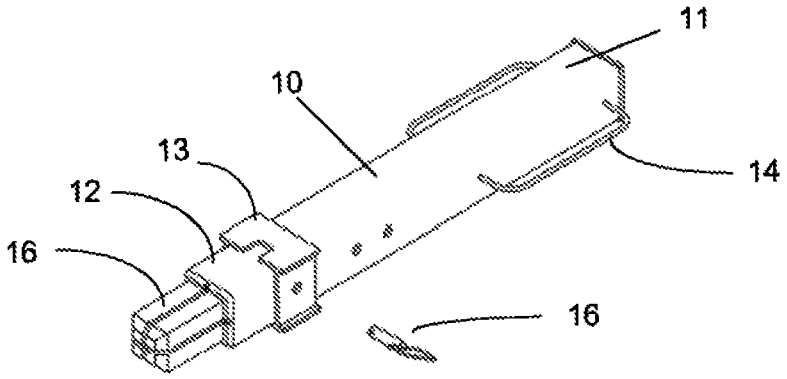
FIG. 2 illustrates a preferred embodiment of a tool used to drive the post mount into a substrate.

A tool 10 is shown in FIG. 2 that is used to drive the post mount 1 into a substrate. The tool 10 includes an impact end 11, a driving end 12 and a collar 13. The handles 14 are used for positioning the tool 10 and in alternative embodiments may take many other suitable forms. The driving end 12 of the tool 10 is inserted into the insert 3 of the post mount 1. The slots 15 of the tool 10 then couple with the lower portion 6 of the post mount body 2. A pin 16 may be used for locking the collar 13 in position on the tool 10 using the holes 17 in the collar 13 and the holes 18 in the tool 10. Alternative locking means may be used in place of the pin 16 to releasably lock the collar 13 in position.

Figure 3:
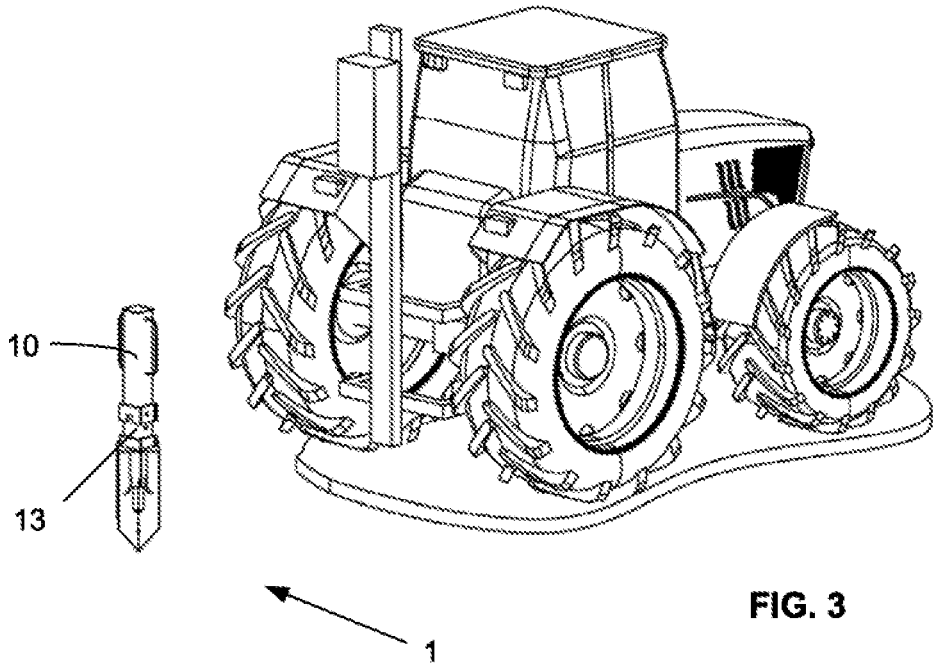
FIG. 3 illustrates a post mount with tool attached being positioned prior to being driven into a substrate.
Figure 4:
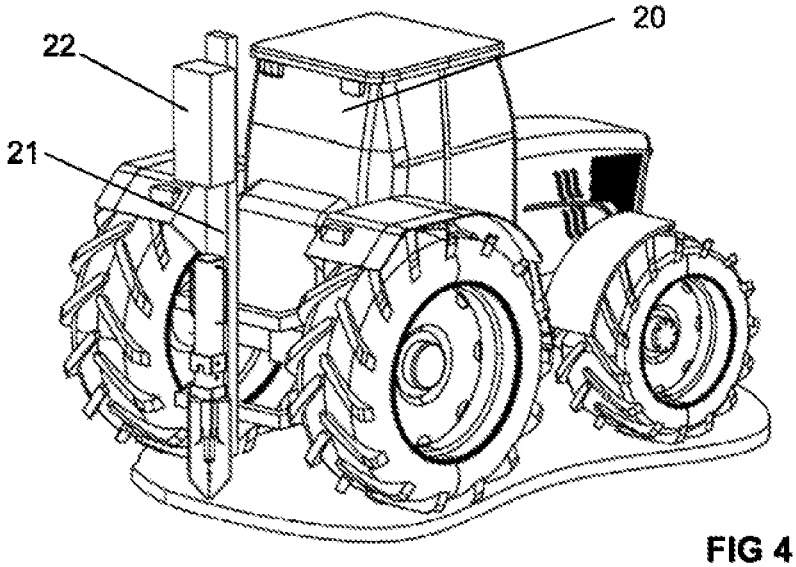
FIG. 4 illustrates a post mount with tool attached in position prior to being driven into a substrate.

FIG. 3 shows the post mount 1 and tool 10 coupled in preparation for the post mount 1 to be driven into the substrate. FIG. 4 shows the assembly from FIG. 3 positioned in a machine 20. The machine 20 includes a guide 21 and a driving implement 22. The machine 20 shown in the figures is a standard tractor with a pile driving attachment, however alternative embodiments would preferably include custom designed and built machines fit for the purpose of installing such a post mount 1. This machine could include a positioning system to accurately and automatically position the post supporting means 1 as it is driven into the substrate. This positioning system could be one of many such known systems, such as GPS, laser tracking and measuring devices or any other suitable system. The machine could also include a device for storing multiple post mounts 1 and a mechanism to automatically load and install each post mount 1.

Figure 5:
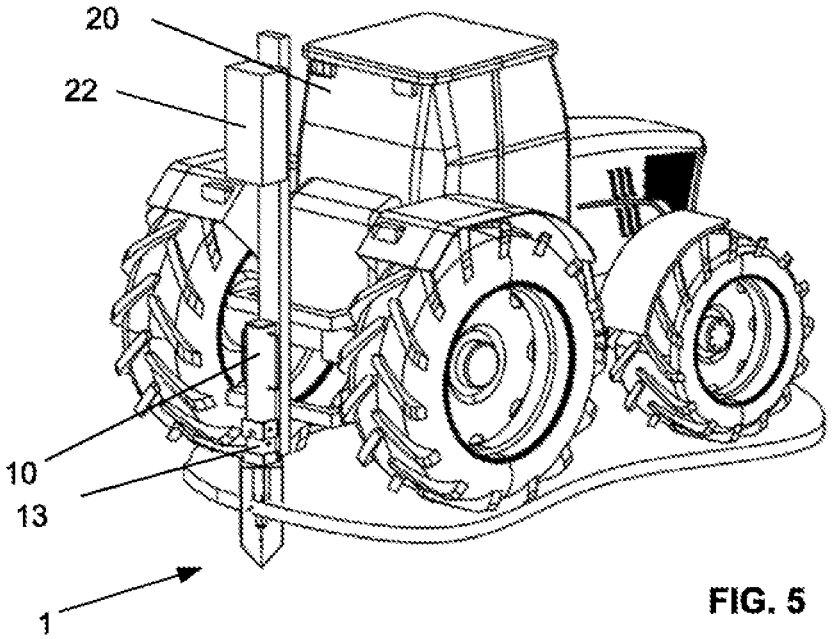
FIG. 5 illustrates a post mount that has been partially driven into a substrate using a tool and pile driver.

As the post mount 1 is driven by the tool 10, as shown in FIG. 5, the collar 13 is located so that it does not apply pressure to the insert 3. This may be achieved by removing the pin 16 completely and allowing the collar 13 to slide freely, as in FIG. 5, or, by the collar 13 being held by a pin 16 in a position such that it does not apply force to the insert 3.

The method of driving the post mount 1 into the substrate involves applying force, generally through repeated impacts such as from the driving implement 22, to the impact end 11 of the tool 10. The tool 10 transmits this force through to the post mount 1, forcing it into the substrate. The plates that make up the body 2 of the post mount 1 serve to guide the mount 1 through the substrate. The tool 10 may also be tapered at the driving end 12, or have some other desirable shape, such that the tool 10 coupled with the mount 1 forms a suitable shape for being forced more easily into the substrate. The tool 10 also completely fills the void inside the insert 3 so that the substrate material is forced out around the outside of the insert 3. In this way a void will remain inside the insert 3 once the mount 1 is completely installed and the tool 10 is removed.

Figure 6:
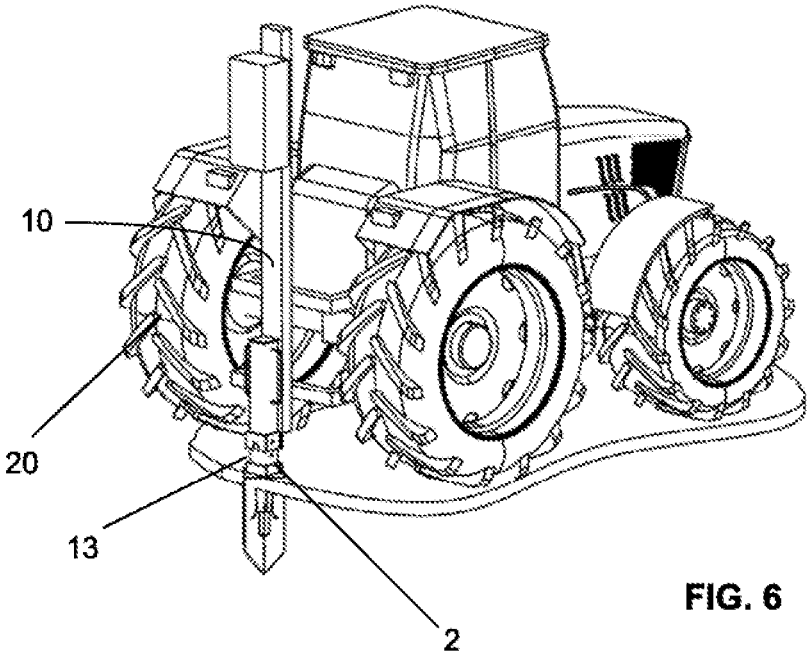
FIG. 6 illustrates a post mount that has been completely driven into the substrate but prior to the insert being driven into the substrate.
Figure 7:
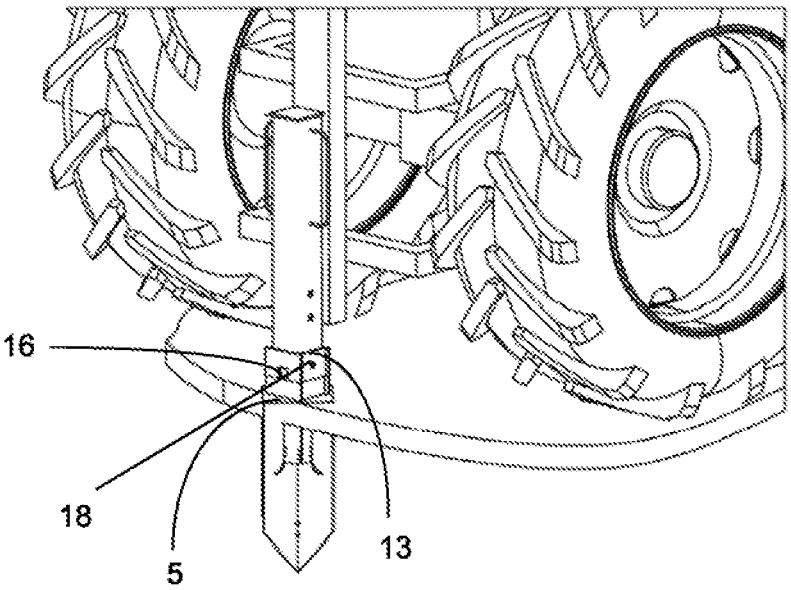
FIG. 7 illustrates a post mount that has been completely driven into the substrate and the insert partially driven into the substrate.

Once the post mount 1 is driven into the substrate, as shown in FIG. 6, the collar 13 is moved to a lower position and locked in place using the pin 16. This is also shown in more detail in FIG. 7. Now when the tool 10 is driven, the collar 13 applies force to the insert 3, rather than the tool 10 applying force to the body 2. This causes the insert 3 to be driven into the substrate relative to the body 2. This relative movement causes the insert 3 to be forced along the slots 4, guiding the insert outwardly such that it is deformed. This collar 13 allows a single tool to be used for both driving the post mount 1 into the substrate and for splaying the insert 3. In alternative embodiments, however, it would also be possible to use separate tools for the two different purposes.

Figure 8:
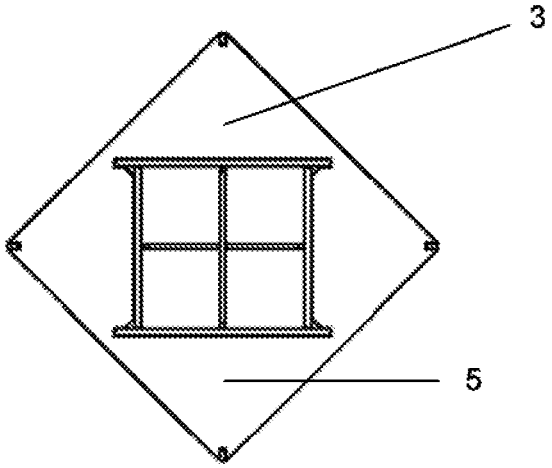
FIG. 8 illustrates a post mount installed in a substrate.

Referring now to FIG. 8, once the insert 3 has been driven sufficiently far into the substrate, the tool 10 is removed. Preferably the insert 3 will be driven far enough that the edge is substantially flush with the flange 5, however depending on the particular substrate conditions this may not always be possible or practical. The installed post mount 1 is now positioned so that the flange 5 abuts the substrate surface and a void is located inside the insert 3.

Figure 9:
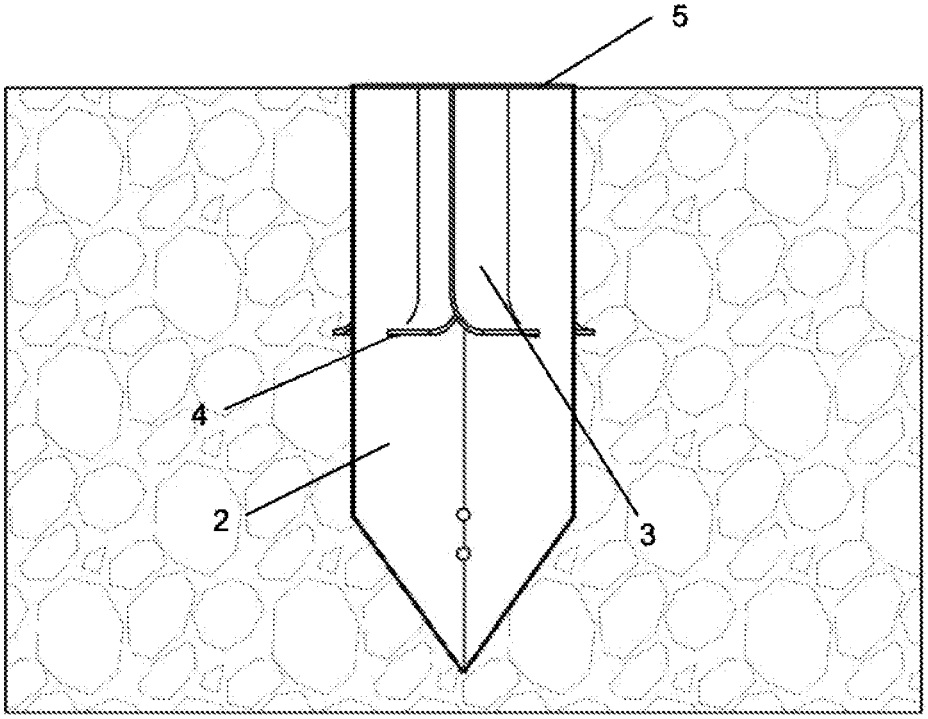
FIG. 9 illustrates a post mount that has been installed in a substrate and then removed by digging away the substrate.

FIG. 9 illustrates the installed post mount 1 where a section of the substrate has been removed, for ease of explanation. This shows how the insert 3 has splayed outwards when deformed by the slots 4. This splaying of the insert 3 has the effect of locking the post mount 1 into the substrate and preventing removal. The splayed portions now being outwardly curved in different directions means for the post mount 1 to be simply pulled out from the substrate in the reverse process to the installation would be very difficult, as it would require far greater deformation to the substrate. By locking the post mount 1 into the substrate in this way, it allows for a much shallower installation depth to provide the same strength when compared to a standard post.

The walls of the insert 3 in the region designed to be splayed will generally not be joined at the corners to allow the walls to separate and conform to the guide more easily during the splaying process. In such an embodiment, the walls may be joined in an upper region and not joined in a lower region, but include break away tabs at a lowermost extremity that prevent deformation during manufacture but fail easily in use.

Figure 10:
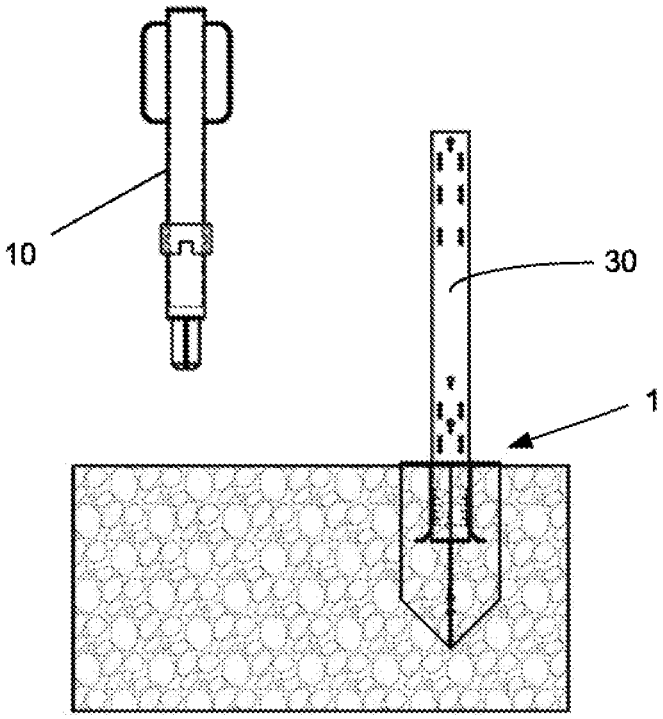
FIG. 10 illustrates a post mount installed in a substrate with a post installed in the mount.
Figures 11, 12, 13, 14, 15:
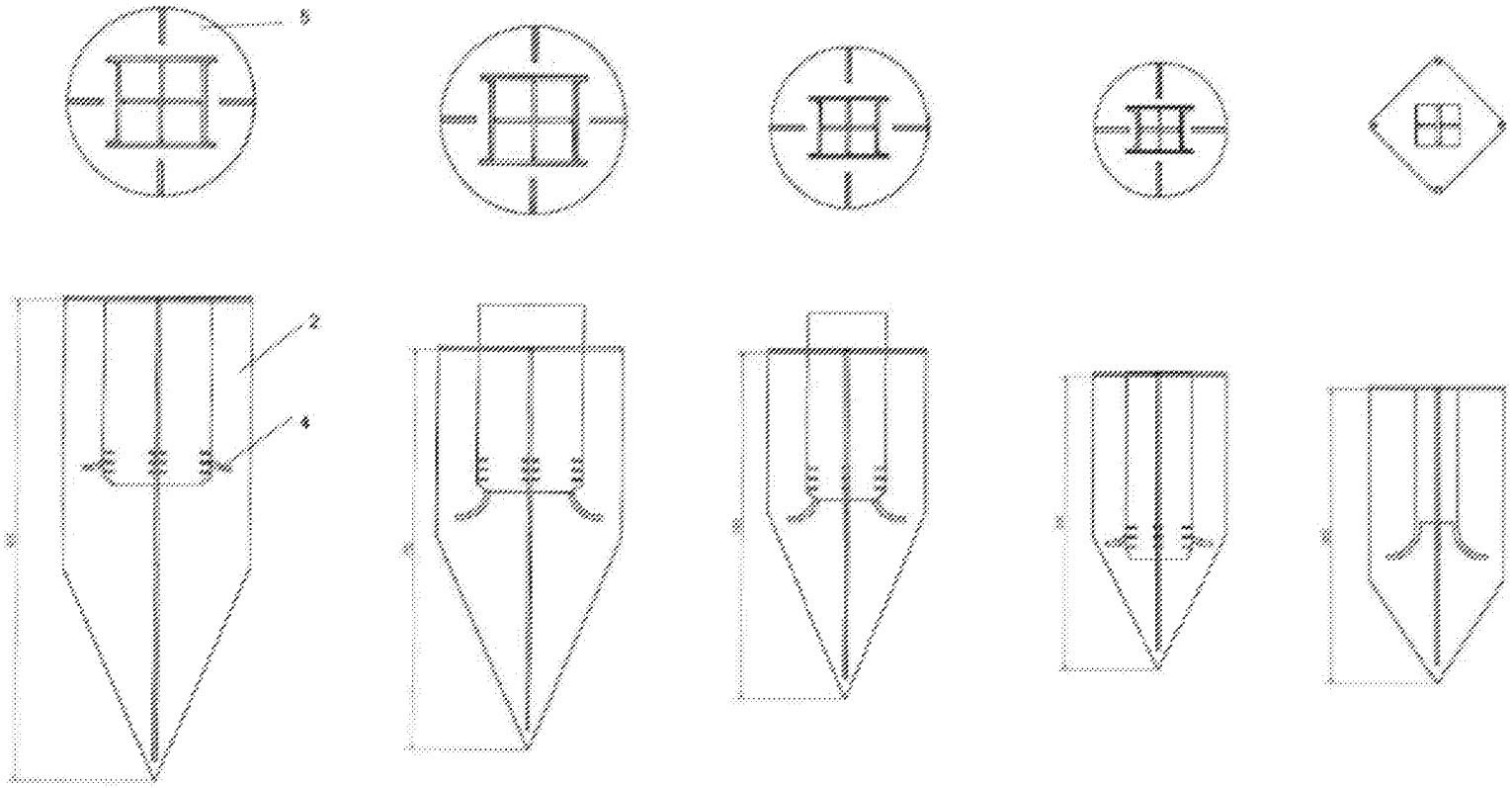
FIG. 11 illustrates a top and side view of an example embodiment of a post mount.
FIG. 12 illustrates a top and side view of another example embodiment of a post mount.
FIG. 13 illustrates a top and side view of another example embodiment of a post mount.
FIG. 14 illustrates a top and side view of another example embodiment of a post mount.
FIG. 15 illustrates a top and side view of another example embodiment of a post mount.
Figure 24A:
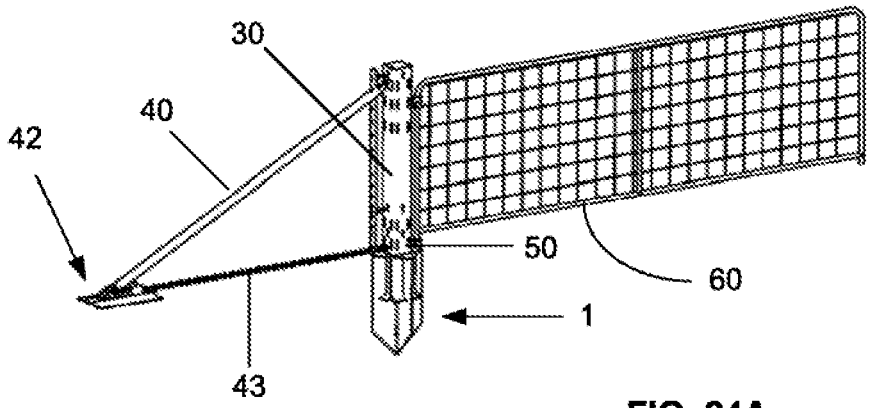
FIG. 24A illustrates a complete setup of post, post mount, adjustable brace and a gate.
Figure 24B:
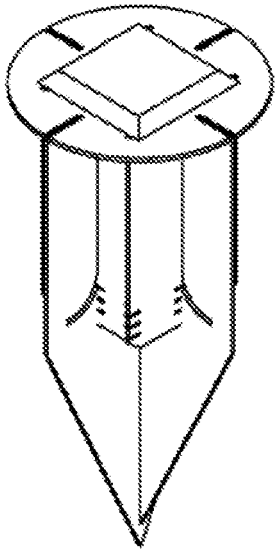
FIG. 24B illustrates a cap to cover the opening when the post is removed from the mount

When installed, the post mount 1 provides an opening, that is, a void in the substrate into which a post 30 can be inserted. FIG. 10 illustrates the post 30 completely installed. Optionally, the post 30 and post mount 1 may include a removable locking means to secure the post 30 in the mount 1. This post 30 and post mount 1, being separate components, provides the additional advantage that the post 30 may be easily removed again at a later time. This may be useful, for example, to move a large piece of machinery, such as a combine harvester, between paddocks. Often these machines are too large to fit through a standard gate and the current invention allows sections of a fence to be dismantled and erected again much more easily. Many other uses for such a removable post are envisaged, including temporarily installing fences for many agricultural or crowd control uses. A cap 35 may also be provided to cover the opening when the post is removed, as shown in FIG. 24B.

FIGS. 11 to 14 show various embodiments of the post mount, where the general design is the same but the size and shape has changed slightly. For example, post mounts of different lengths may be used for different soil types. FIG. 15 shows another embodiment where the flange 5 is square, rather than round.

Figure 17:
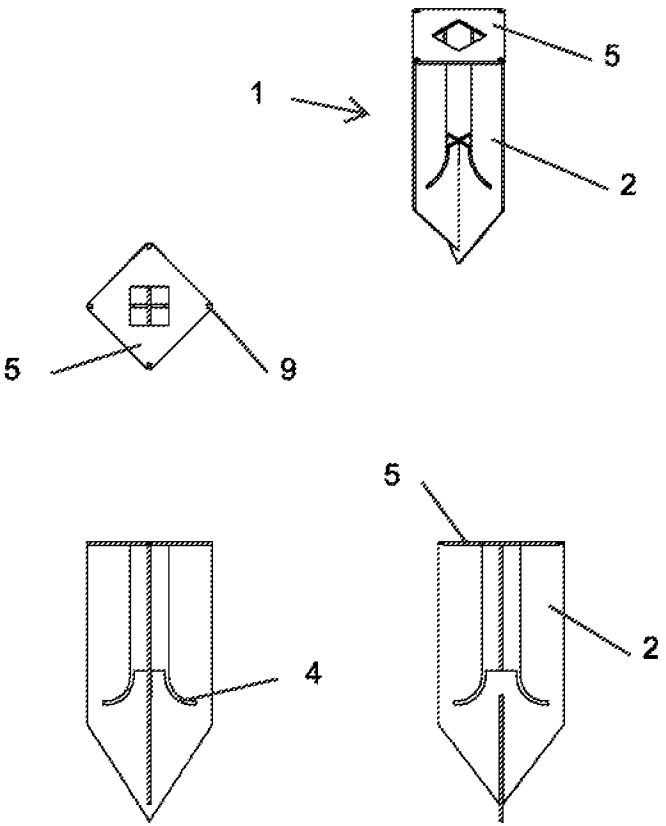
FIG. 17 illustrates a top, two side and a perspective view of an assembled post mount with a square top flange.
Figure 16:
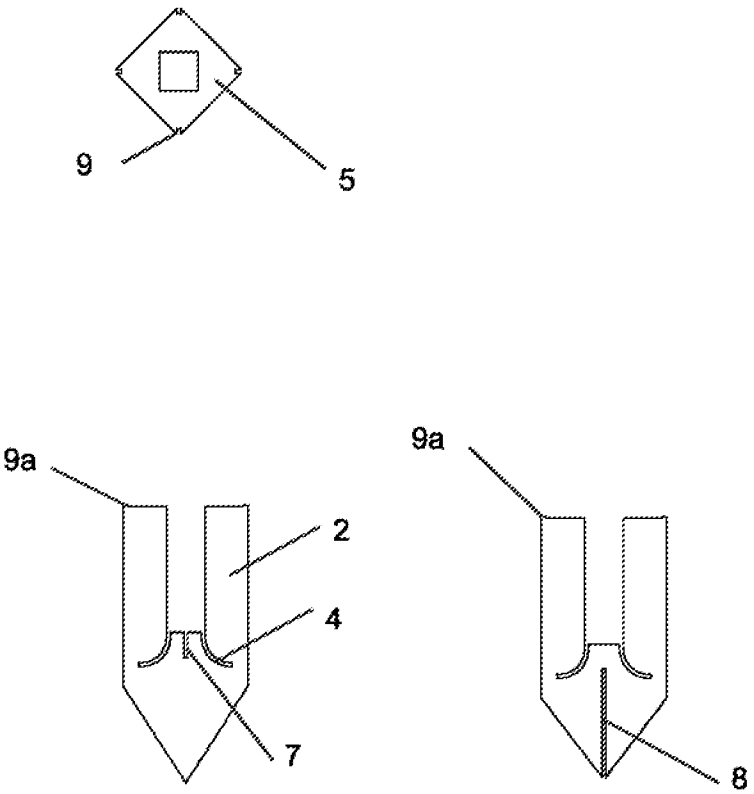
FIG. 16 illustrates a disassembled post mount with a square top flange.

Referring now to FIG. 16, another embodiment is shown with a square flange 5. The post mount 1 is shown separated into the different components used during manufacture. One portion of the body 2 includes a slot 7 extending from a central part while the other portion of the body 2 includes a slot 8 extending from the lower tip. This allows the two slots 7, 8 to be placed over one another, coupling the two portions of the body 2 together and thereby forming a cross shape when viewed from a top angle. The flange 5 can then be attached to the top, wherein short slots 9 at the corners mate with small tabs 9*a* at the top end of the portions of the body 2. FIG. 17 shows the embodiment from FIG. 16 once assembled to form a complete post mount 1.

Figure 18A:
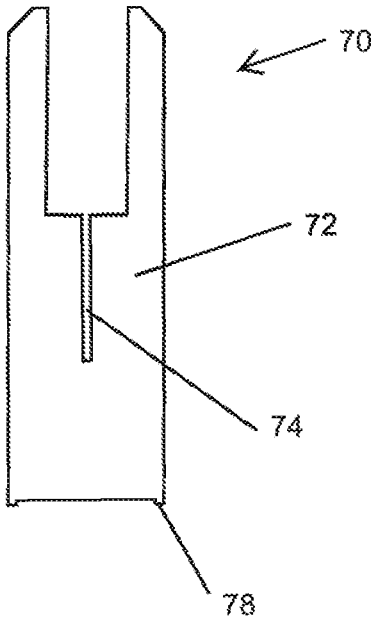
FIG. 18A illustrates a side view of one component of a post mount that is not designed to be driven into the ground.
Figure 18B:
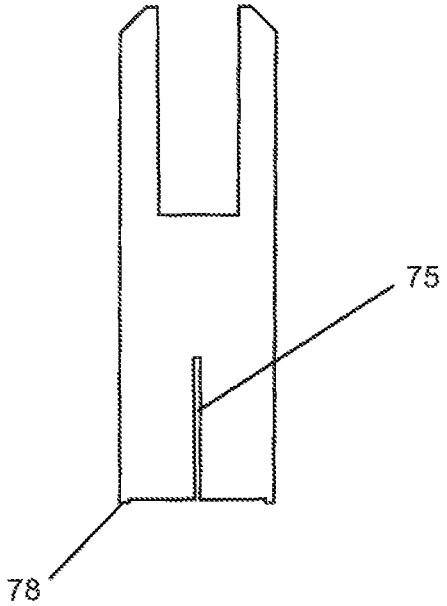
FIG. 18B illustrates a side view of another component of a post mount that is not designed to be driven into the ground.
Figure 18C:
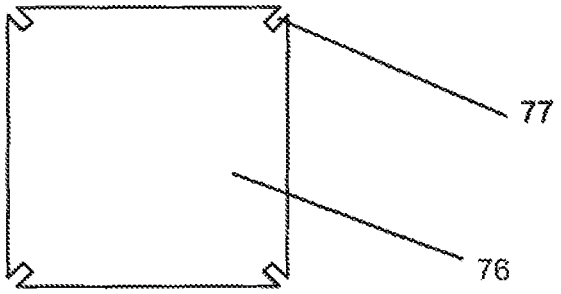
FIG. 18C illustrates a top view of a bottom flange of a post mount that is not designed to be driven into the ground.

FIGS. 18A to 18C show the components used to make an alternative form of post mount 70. This embodiment includes a main body portion 72 that forms a cross shape when viewed from a top angle. It is formed by mating a slot 74 of one portion with a slot 75 of the other portion in a similar fashion to the post mount 1 and as described in relation to FIG. 16. In this version of the post mount 70, however, a flange 76 is located at the bottom of the post mount 70. The flange 76 is attached by mating slots 77 with tabs 78. Therefore, rather than drive this post mount 70 into the ground, a hole is drilled into the substrate first, allowing the post mount 70 to be inserted and buried such that the flange 76 is under the surface, anchoring the post mount 70 into the substrate. In this embodiment, the post 30 may be permanently attached to the post mount 70.

Figure 19A:
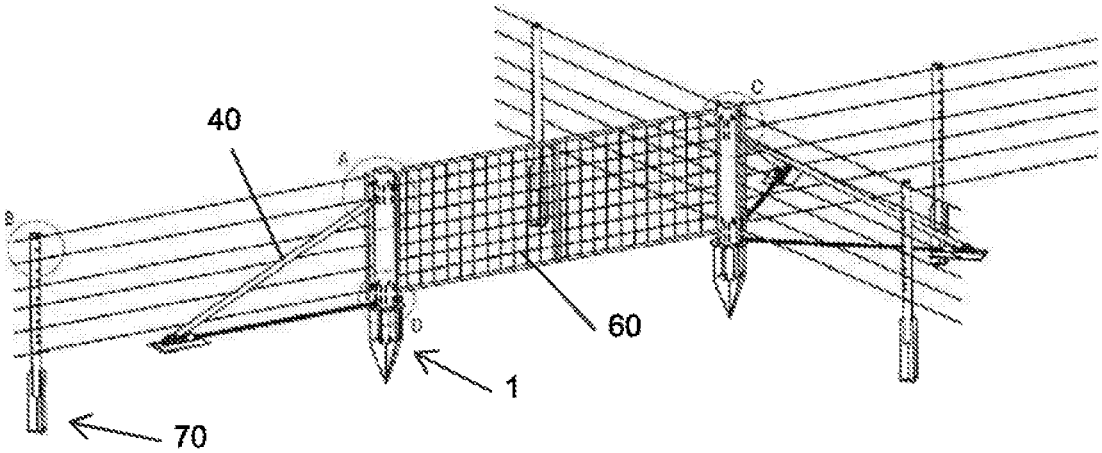
FIG. 19A illustrates a perspective view of a complete fence and gate assembly.
Figure 19B:
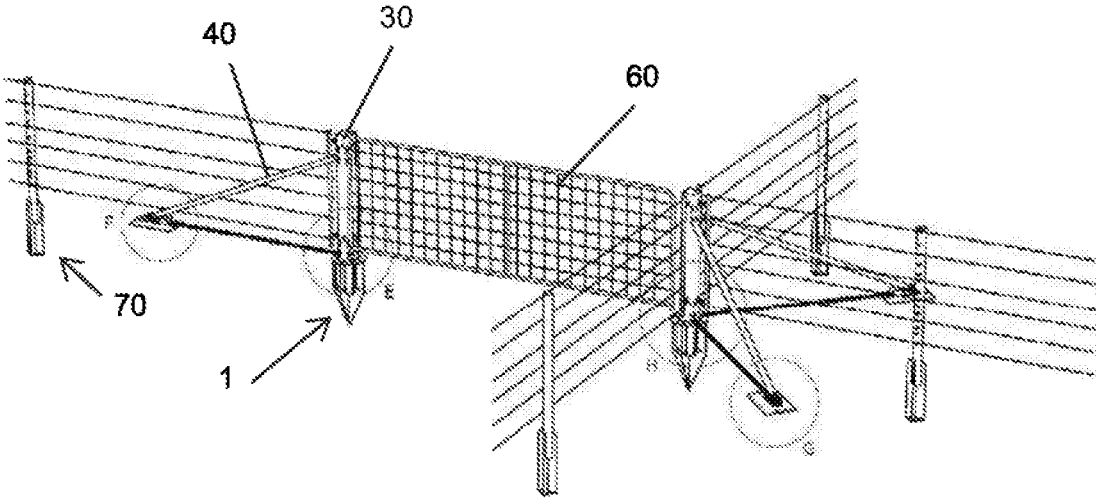
FIG. 19B illustrates a different perspective view of the complete fence and gate assembly from FIG. 19A.

FIGS. 19A and 19B illustrate a complete fence and gate setup, as they may typically be implemented in practice. Post mounts 70 are used to support sections of the fence while post mounts 1 are used to support posts 30 for attaching a gate 60, however the different types of post mounts 1, 70 are interchangeable. A brace 40 is shown for use in supporting a post 30.

Figure 20A:
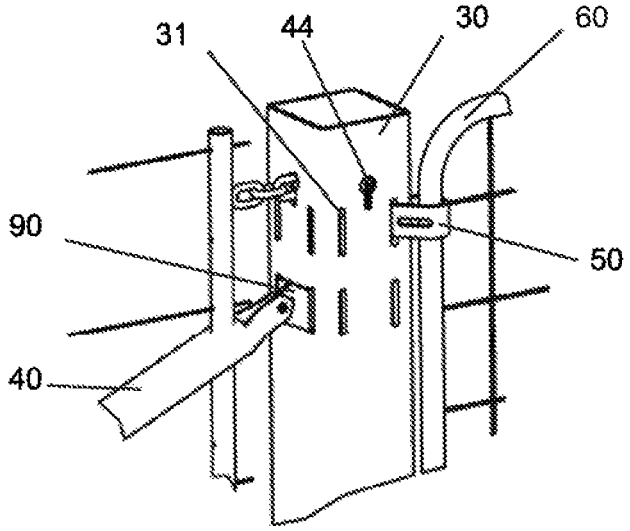
FIG. 20A illustrates an enlarged view of circle A from FIG. 19A.

FIG. 20A shows the top end of a post 30 with various items attached. This section of the post 30 includes four vertical slots 31 on each face that can be used for coupling with various connectors, however any number of vertical slots 31 could be provided. In this figure a gate 60 is attached to a corner of the post 30 using a gate connecting bracket 50. A brace 40 is attached to a face of the post 30 using a connecting bracket 90 and a fence is connected using alternative attachment holes 44. A device for automatically opening and closing the gate could also be added, for example using bracket 90, as described below and shown in FIGS. 63A to 63C.

Figure 20B:
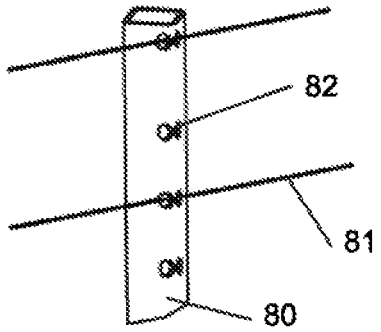
FIG. 20B illustrates an enlarged view of circle B from FIG. 19A.

Referring to FIG. 20B, an alternative fence post 80 is shown that is used for supporting fence wires 81. The post 80 includes holes 82 through which the wires 81 may be threaded. These holes 82 may be formed by two separate openings, requiring the wire 81 to be threaded through. Alternatively, the two openings may be connected by a small gap, allowing the wire to be pushed in from the side. In this situation a wire 83 can then be fed down the inside of the post 80, towards the outside of the wires 81, thereby locking the wires 81 inside the holes 82 of the post 80. This is shown in more detail in FIGS. 20I and 20J. Alternatively, any other suitable fencing material may be used in place of the wires 81.

Figure 20C:
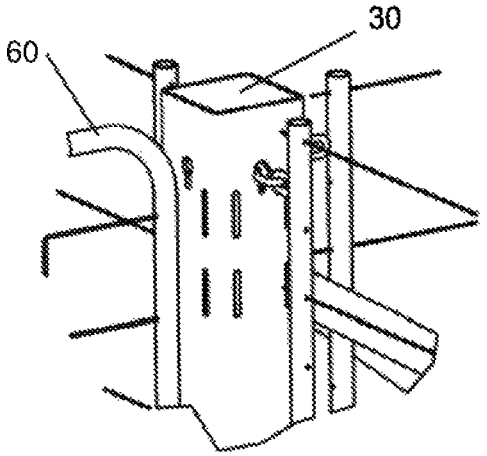
FIG. 20C illustrates an enlarged view of circle C from FIG. 19A.
Figure 20D:
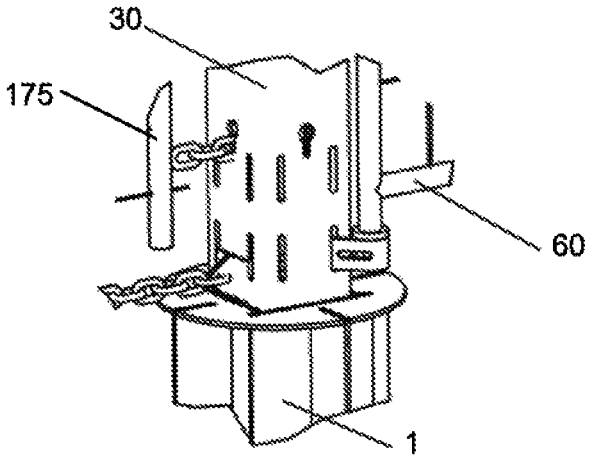
FIG. 20D illustrates an enlarged view of circle D from FIG. 19A.
Figure 20E:
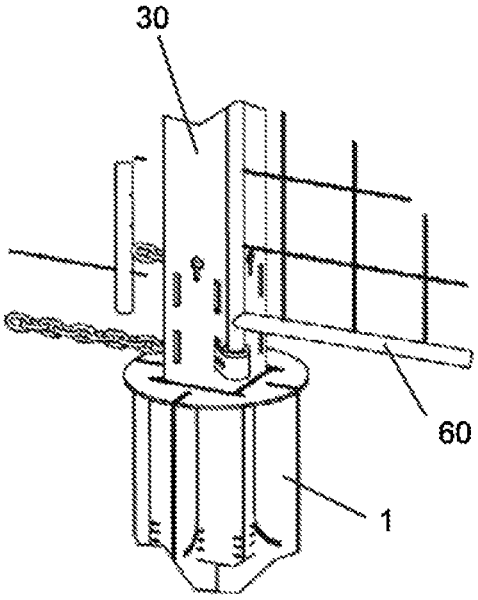
FIG. 20E illustrates an enlarged view of circle E from FIG. 19B.

Referring to FIG. 20C, the top end of another fence post 30 is shown. The vertical slots here may be used to attach a latch for retaining the gate 60 in a closed position; however this is not shown in this figure. Such a latch could be attached using brackets 90, for example. FIG. 20D shows the bottom end of the fence post 30 from FIG. 20A, while FIG. 20E shows the bottom end of the fence post 30 from FIG. 20C. These figures illustrate the attachment of the wires 81 to the post 30, where the wires are attached to a vertical member 175 which is then attached to the post 30 using chains and the alternative attachment holes 44. Again in this situation, however, bracket 90 could be used to attach the chains.

Figure 20F:
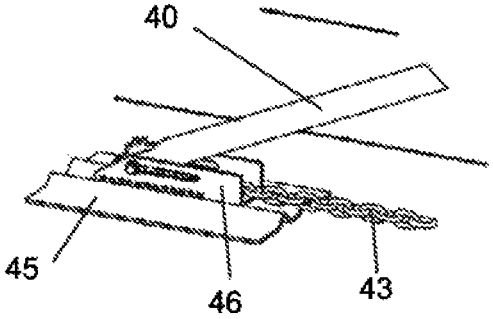
FIG. 20F illustrates an enlarged view of circle F from FIG. 19B.
Figure 20G:
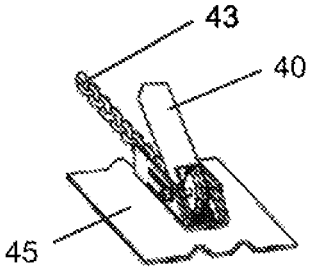
FIG. 20G illustrates an enlarged view of circle G from FIG. 19B.

Referring to FIG. 20F, an end of a brace that abuts the ground is shown. This end includes a plate 45 and an adjustment mechanism including a guide 46 which connects to the brace 40 and the chain 43. FIG. 20G also shows this plate 45 and other components from a different angle.

Figure 20H:
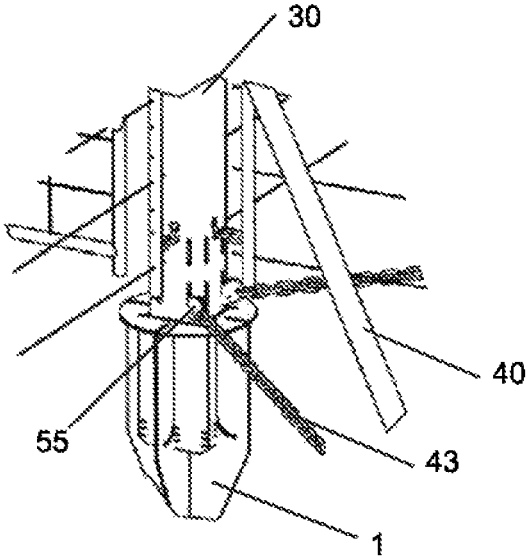
FIG. 20H illustrates an enlarged view of circle H from FIG. 19B.
Figure 20I:
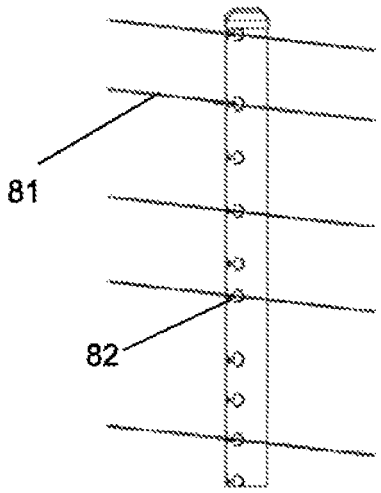
FIG. 20I illustrates a post with fencing wire attached and secured in place using a wire threaded inside the post.
Figure 20J:
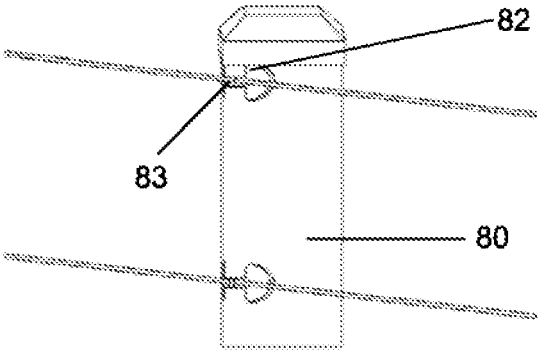
FIG. 20J illustrates an enlarged view of FIG. 20J.

Referring to FIG. 20H, the bottom end of a fence post 30 is shown with chains 43 attached at the corners using corner connecting brackets 55.

Figure 21:
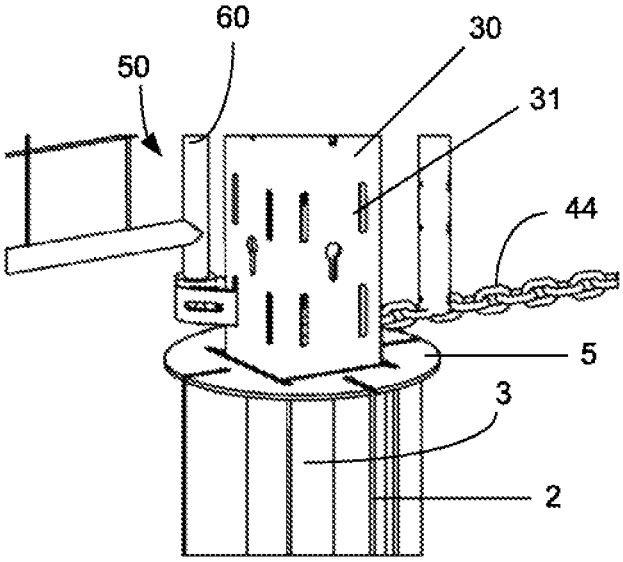
FIG. 21 illustrates a post and post mount with attachment means to which a gate has been connected.
Figure 22:
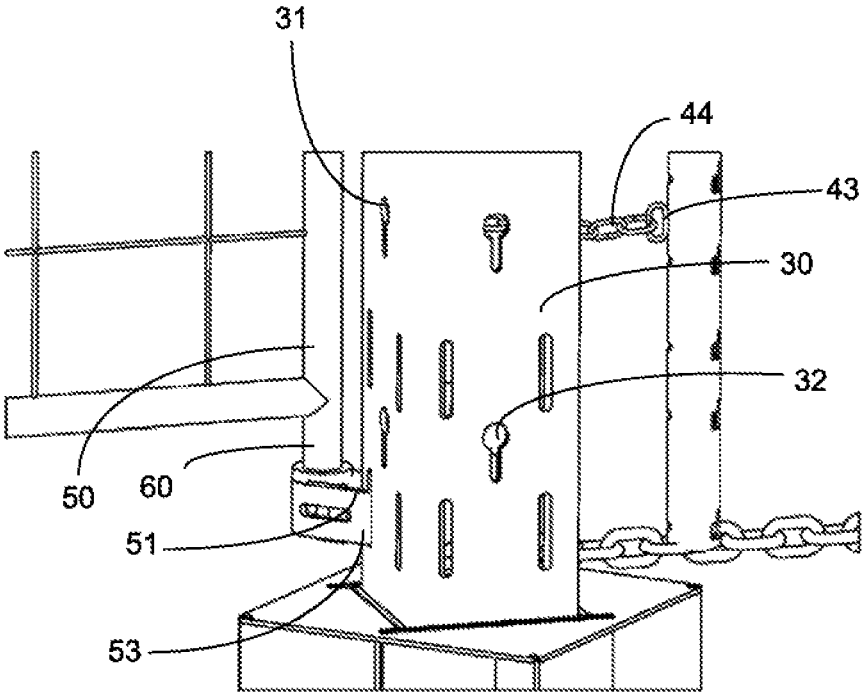
FIG. 22 illustrates the attachment means by showing the post in transparent form.

In an alternative embodiment, a bracket 50 can be used to attach items such as a gate 60 to the post 30, as shown in FIG. 21. This bracket 50 is shown in more detail in FIG. 22, where a tab 51 is shown for attaching to the gate 60, while internal tabs 52 and external tabs 53 are used for attaching to the post 30. The internal tabs 52 are L shaped plates inserted into slots 31 in the post 30. The entire bracket 50 then slides downward, locking into engagement with the post 30. The external tabs 53 may also be bolted to the post 30 for a more permanent connection. The attachment of the chain 43 is also shown, which may include use of alternative holes 44 in the post 30.

Figure 23:
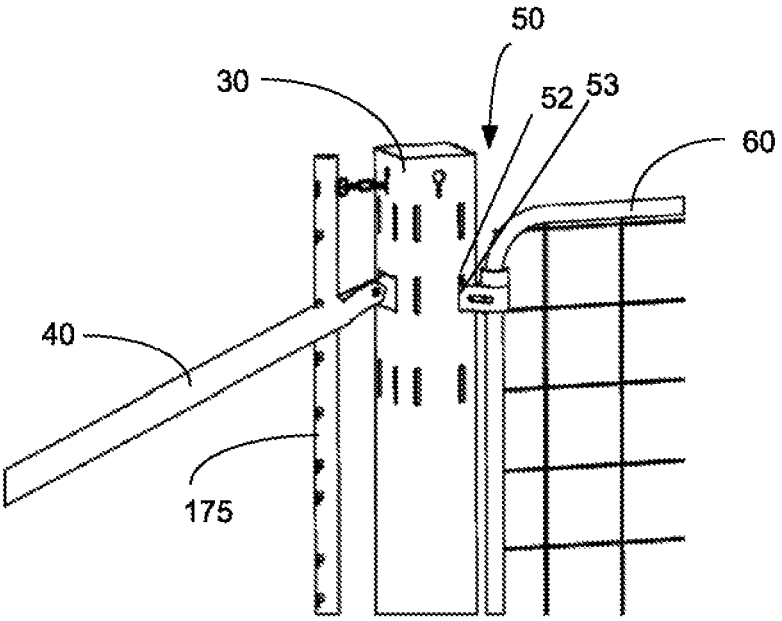
FIG. 23 illustrates a gate and an adjustable brace connected to a post using the attachment means.

Referring to FIG. 23, a similar bracket 50 may be used for the brace 40, where internal tabs 52 are again inserted into slots in the post 30 and external tabs 53 abut the outside of the post 30. FIG. 24A shows a complete setup including post mount 1, post 30 with gate 60 and brace 40 attached using brackets 50.

Figure 25:
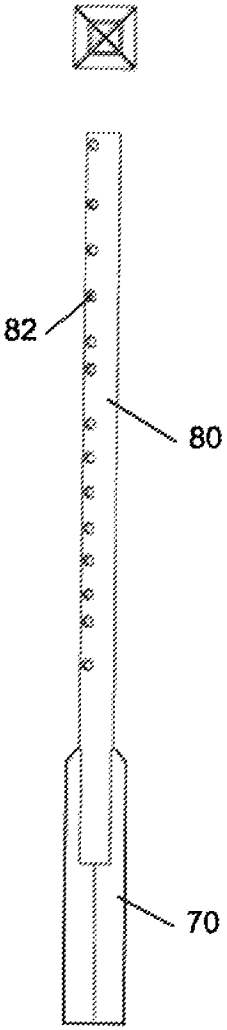
FIG. 25 illustrates a top and side view of a fence post with fence wire attachment holes coupled with a post mount that is not designed to be driven into the ground.

Beginning at FIG. 25, various components from the above assemblies are shown individually in more detail. FIG. 25 shows the alternative post 80 with holes 82 for connecting fence wires 81 (or other fencing material) coupled with an alternative post mount 70.

Figure 28:
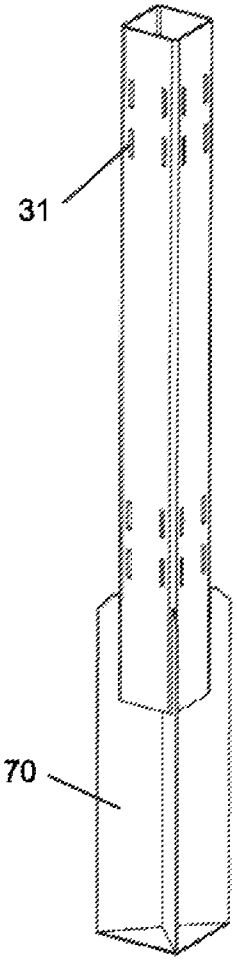
FIG. 28 illustrates a perspective view of the embodiment from FIG. 27.
Figure 27:
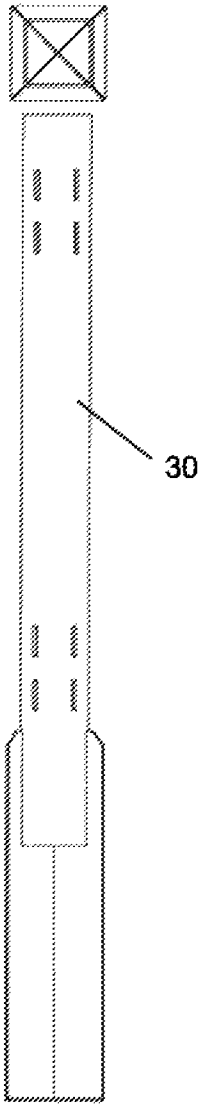
FIG. 27 illustrates an alternative embodiment similar to that in FIG. 26.
Figure 26:
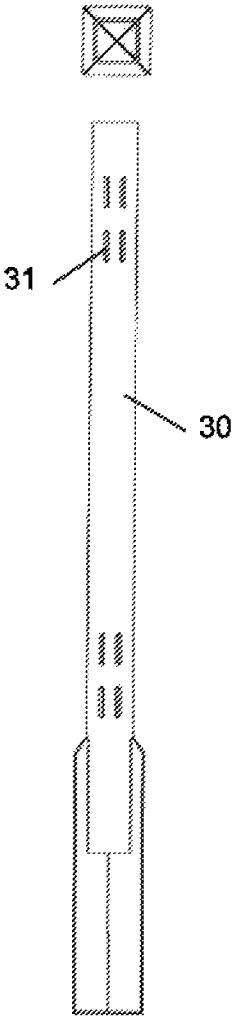
FIG. 26 illustrates a top and side view of an embodiment similar to that in FIG. 25, where the fence post includes attachment points for a gate or brace.
Figure 29:
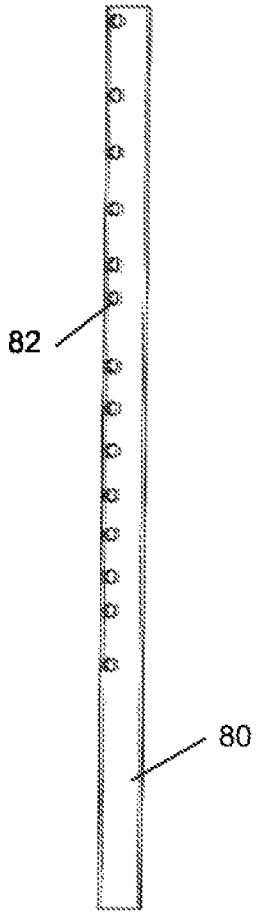
FIG. 29 illustrates a side view of the fence post from FIG. 25 separate from the post mount.
Figure 30:
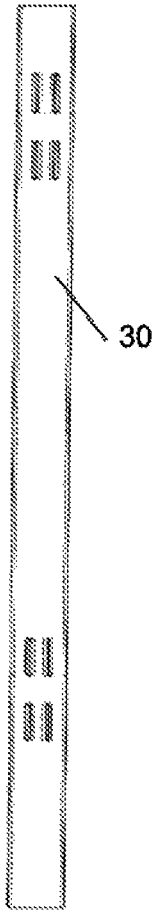
FIG. 30 illustrates a side view of the fence post from FIG. 26 separate from the post mount.
Figure 31:
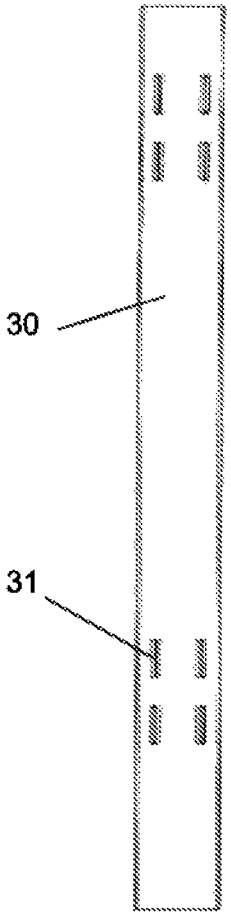
FIG. 31 illustrates a side view of the fence post from FIG. 27 separate from the post mount.

FIGS. 26, 27 and 28 show different sizes of fence posts 30 with slots 31, also coupled to alternative post mounts 70. FIGS. 29, 30 and 31 show the same posts 80, 30 without the post mount 70. In FIGS. 26 and 30 a narrower post is shown; however the labels 30 and 31 may be used to indicate a post of any size unless otherwise indicated.

Figure 33:
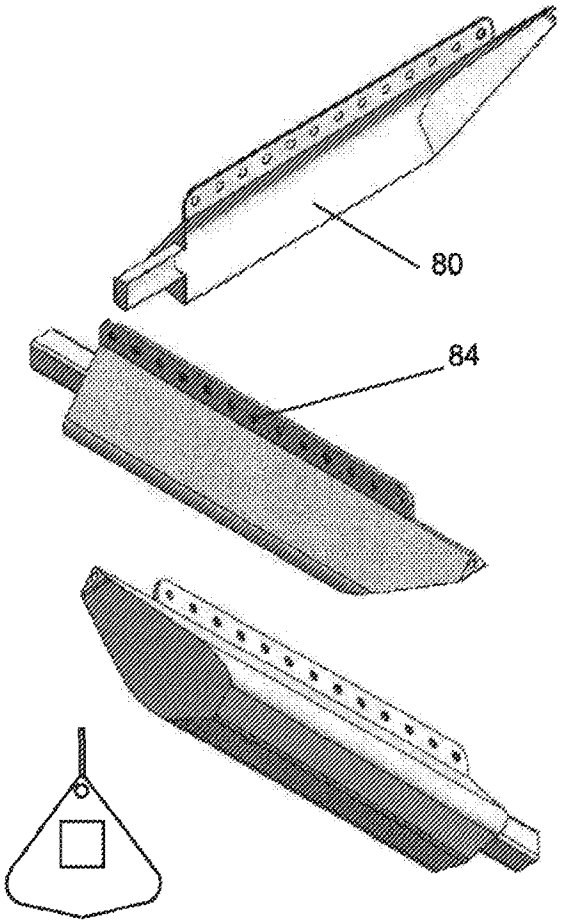
FIG. 33 illustrates various perspective angles of the fence post from FIG. 32.
Figure 32:
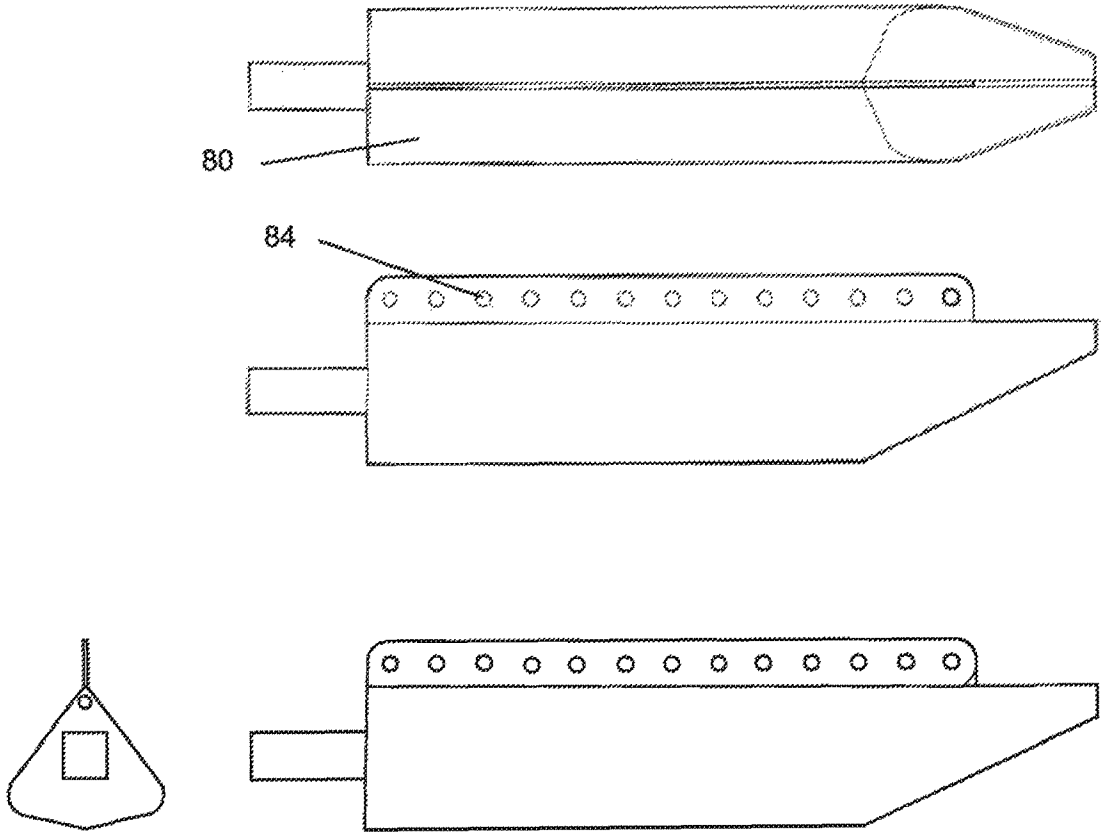
FIG. 32 illustrates top, end and side views of an alternative fence post embodiment with holes for attaching fence wires.

Referring to FIGS. 32 and 33, alternative embodiments of the fence post 80 are shown, where holes 84 are drilled through a flange. This post 80 may be releasably attached to the post mount 70 and the body of the post 80 buoyant, so that in the event of a flood the fence is released from the ground and able to float on the surface of the water, thereby preventing damage to the fence.

Figure 35:
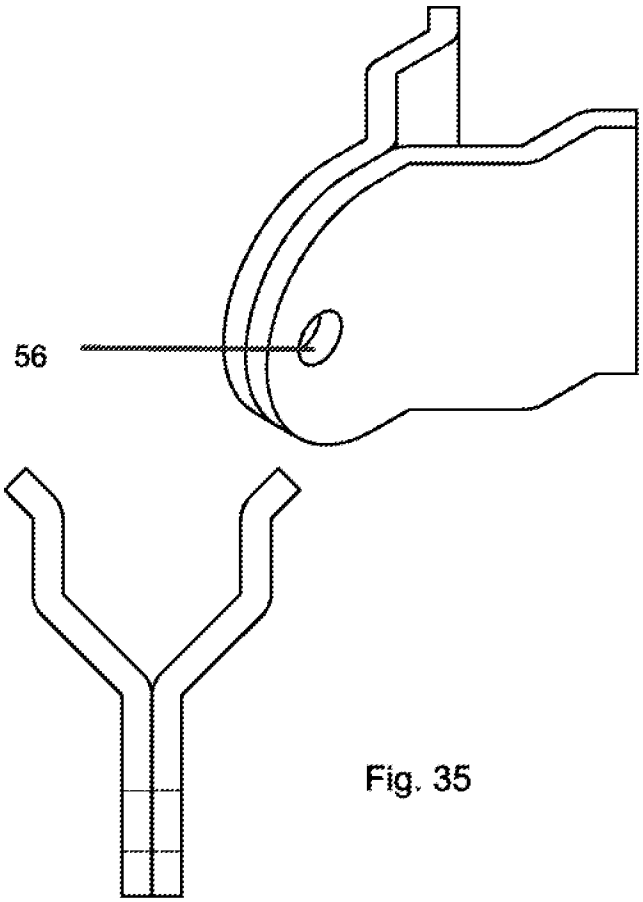
FIG. 35 illustrates a perspective and end view of a pair of corner connecting brackets in an assembled position.
Figure 34:
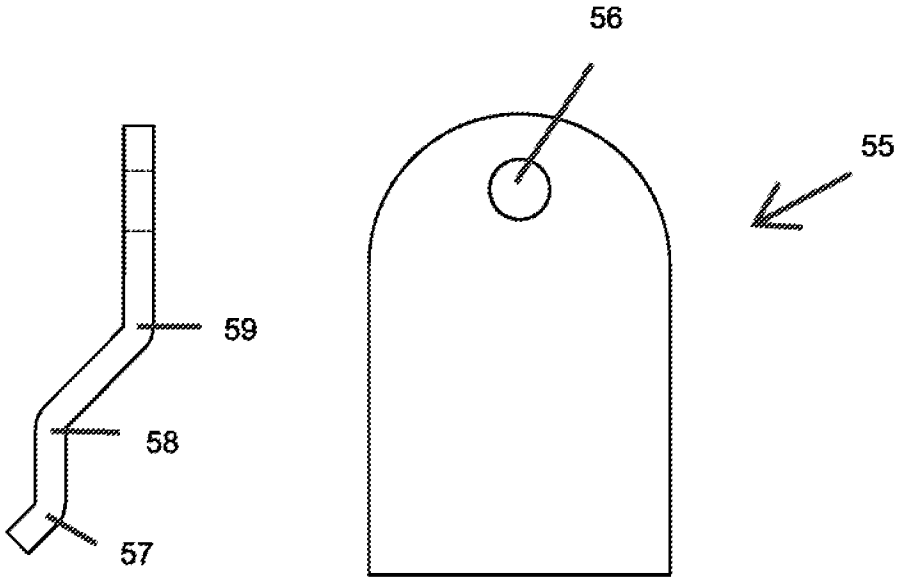
FIG. 34 illustrates a side and end view of a corner connecting bracket.

Referring to FIGS. 34 and 35, a corner connecting bracket 55 is shown. Each bracket 55 includes a hole 56 and is formed of a flat sheet with a first bend 57, second bend 58 and third bend 59 as shown in FIG. 34. The brackets are used as a pair as shown in FIG. 35, wherein the sections that include the holes 56 abut, leaving the other ends separated and free to be inserted into slots 31 on either side of the corner of a post 30. The shape of the slots 31 and connecting brackets 55 are such that each bracket is inserted into a slot separately, but once the ends are connected using the holes 56 the shape of the brackets locks them to the post 30.

Figure 37:
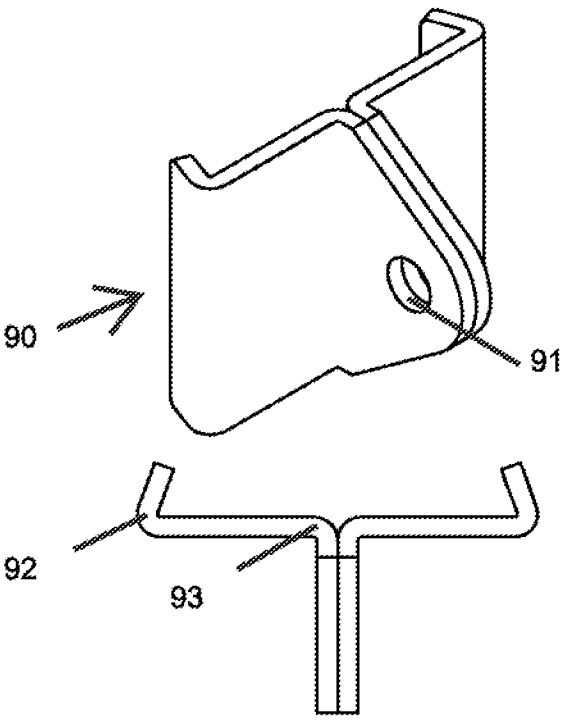
FIG. 37 illustrates a perspective and end view of a pair of connecting brackets in an assembled position.
Figure 36:
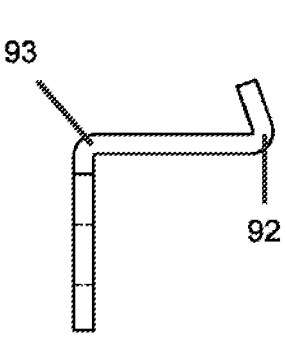
FIG. 36 illustrates a side and end view of a connecting bracket.
Figure 36:
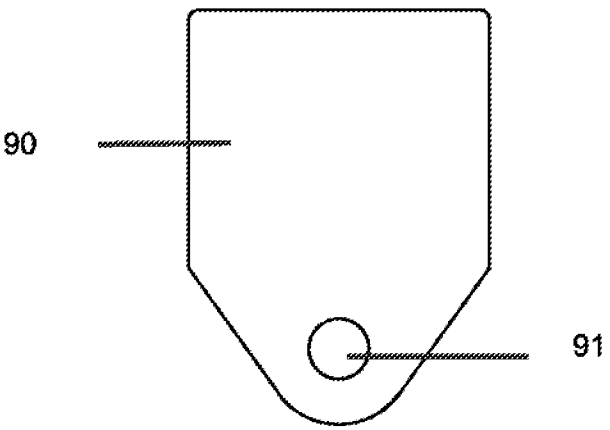

FIGS. 36 and 37 show a wide connecting bracket 90 designed for attaching to a face of a post 30 using the slots 31. Again the brackets 90 are formed from a sheet with a hole 91, however now only have two bends 92, 93. The ends of the brackets 90 furthest from the holes 91 are inserted into two slots 31 adjacent one another on the same face of the post 30, and once the ends of the brackets 90 are connected using the holes 91, the bracket 90 is locked to the post 30.

Figure 39:
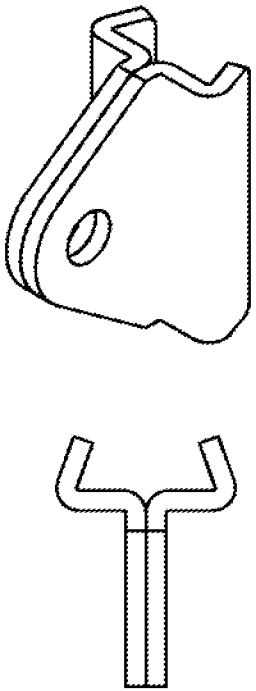
FIG. 39 illustrates a perspective and end view of a pair of connecting brackets in an assembled position.
Figure 38:
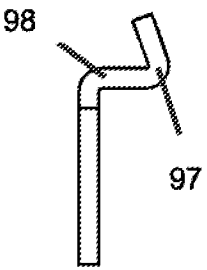
FIG. 38 illustrates a side and end view of a connecting bracket.
Figure 38:
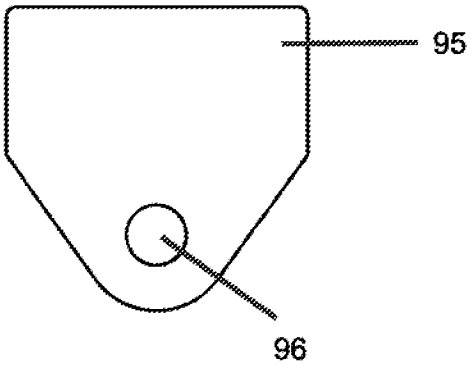

FIGS. 38 and 39 show a narrow connecting bracket 95 with holes 96 and bends 97, 98. This bracket 95 is similar to the previous bracket 90, but has the bends 97, 98 closer together so that the brackets 95 as a pair are narrower and can therefore connect to slots 31 of a post 30 that are closer together. For example, the wide bracket 90 may connect to a post 30 as shown in FIG. 31, while the narrow bracket 95 may connect to slots 31 of a post 30 as shown in FIG. 30. Preferably, the slots 31 of the post 30 in FIG. 30 are the same distance from the corner of the post 30 as the slots 31 are from the corner of the post 30 in FIG. 31, thereby allowing the same corner bracket 55 to be used with either size post 30.

In a preferred embodiment of the post 30, the side walls of the slots 31 are at an angle of about 45° to the face of the post 30, such that the side walls of the slots 31 on either side of a corner (i.e. a pair to which a corner connecting bracket 55 connects to) are parallel to one another. This design for the slots 31 when combined with the shape of the various brackets 55, 90, 95 assists in achieving a secure and strong coupling of the brackets with the posts 30.

Figure 41:
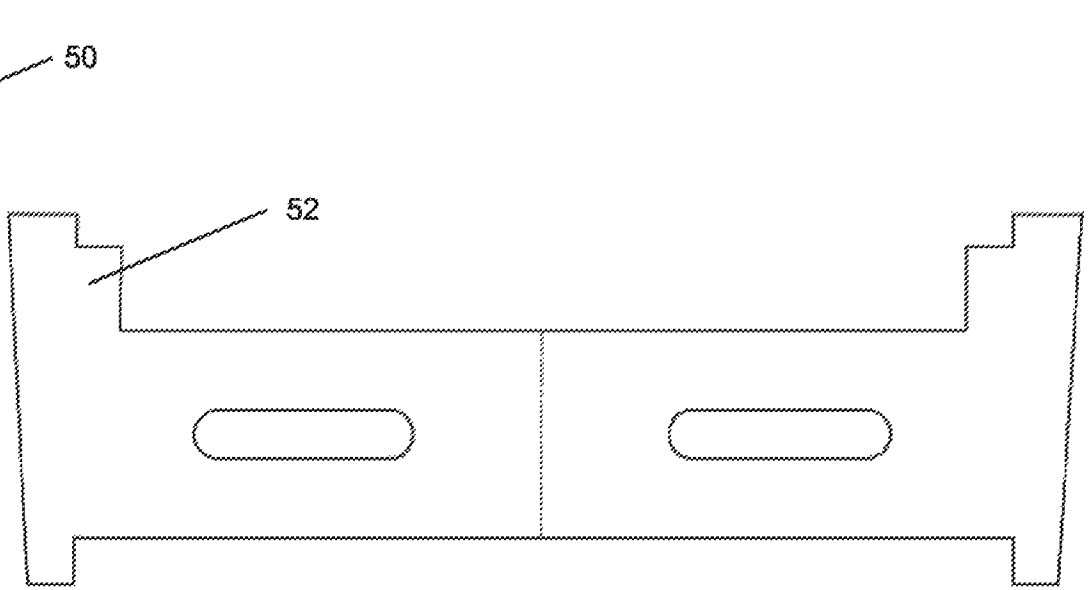
FIG. 41 illustrates a side view of a gate connecting bracket prior to being bent into a U shape.
Figure 40:
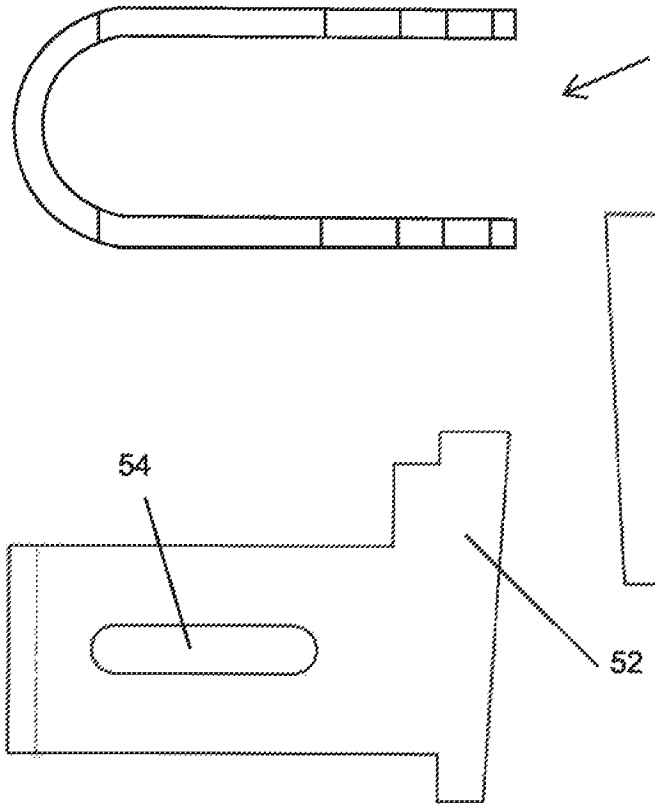
FIG. 40 illustrates a top and side view of a gate connecting bracket.

Referring to FIG. 40, a gate connecting bracket 50 is shown. The bracket 50 includes an end 52 for connecting to a post 30 using slots 31 and a slot 54 for use when connecting a gate or associated adapters. The bracket 50 is in a U shape when viewed from above, such that there are two ends 52 that each fit into a slot 31. FIG. 41 shows the bracket in a flattened form prior to bending into a U shape. As the side walls of the slots 31 are angled, as described above, this bracket attaches to the corner of a post 30. Further, as the slots 31 on different sized posts 30 are the same distance from the corner of the post 30, the same gate bracket 50 can be used on any sized post 30. Attaching the gate bracket 50 to the corner of the post 30 also allows rotation of the gate 60 up to about 270° during use. The gate bracket 50 is attached to a post 30 simply by inserting the larger part of the ends 52 into respective slots 31 and then rotating so that the smaller part of the ends 52 are in the slots 31, after which the bracket 50 is lowered slightly and thereby locked in place with the tabs of the ends 52 behind the wall of the post 30.

Figure 43C:
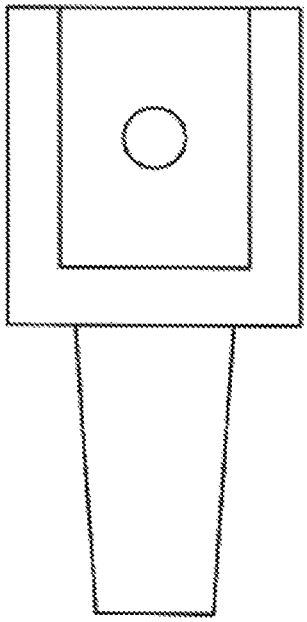
FIG. 43C illustrates a side view of a gate connecting spear.
Figure 43B:
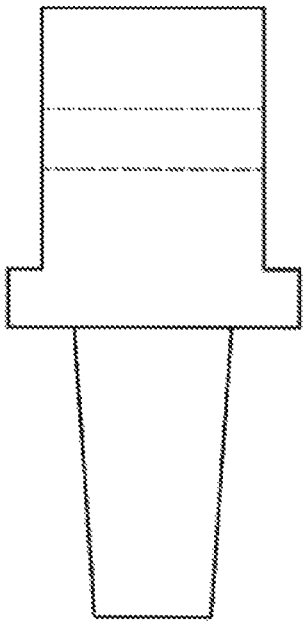
FIG. 43B illustrates an end view of a gate connecting spear.
Figure 42:
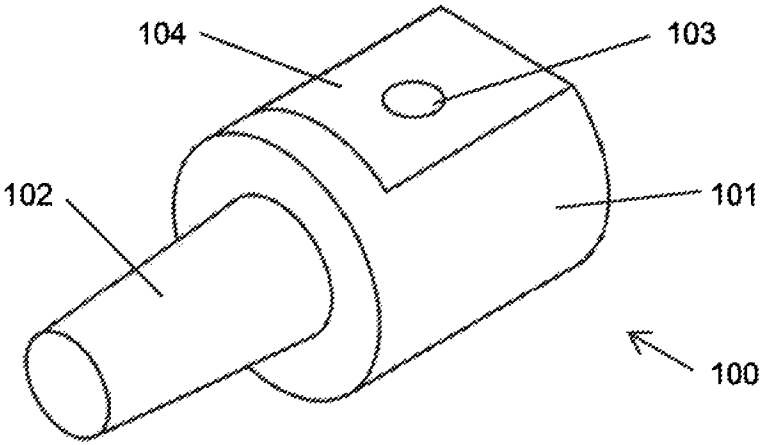
FIG. 42 illustrates a perspective view of a gate connecting spear.
Figure 43A:
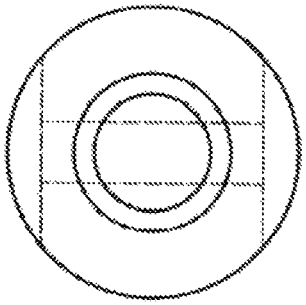
FIG. 43A illustrates a top view of a gate connecting spear.
Figure 44:
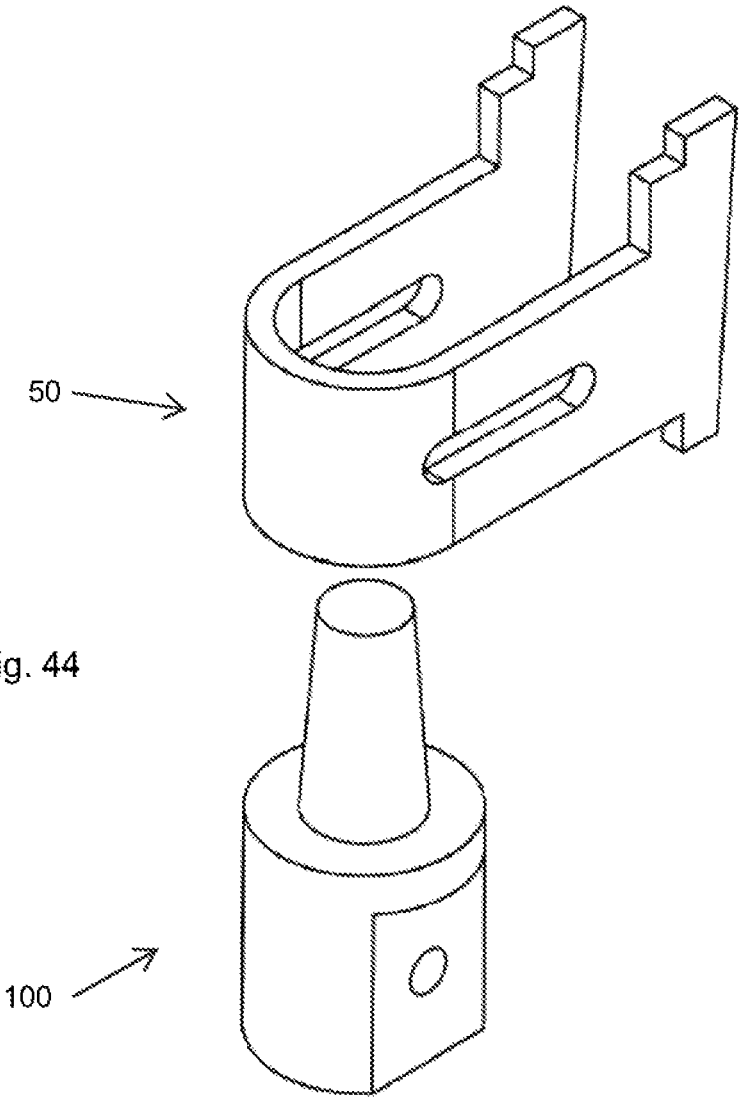
FIG. 44 illustrates a perspective view of a gate connecting bracket and a gate connecting spear prior to assembly.

FIGS. 42 and 43 show a gate connecting spear 100, that connects the bottom of a gate 60 with the gate connecting bracket 50. The connecting spear 100 includes a wide end 101 and a tapered end 102. The wide end 101 includes a hole 103 drilled such that the openings are on a face that forms part of a cutout 104. The cutouts 104 allow the wide end 101 to slot into the connecting bracket 50 such that the hole 103 aligns with the slot 54, after which a bolt may be inserted to lock the spear in place in the bracket 50. The tapered end 102 then points in an upward direction, allowing a gate 60 to be lowered onto the tapered end 102 and rotate about the connecting spear 100 while supporting the weight of the gate 60. FIG. 44 shows the bracket 50 and connecting spear 100 aligned prior to connecting, however the connecting spear 100 can only be inserted into the bracket 50 from above.

Figure 45:
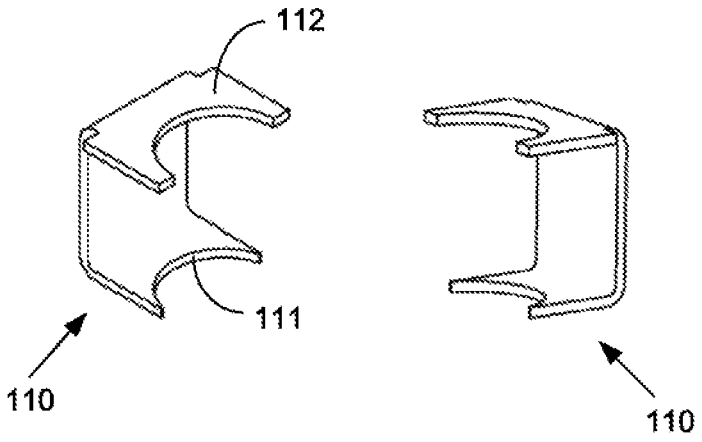
FIG. 45 illustrates two perspective views of a gate connecting adapter.
Figure 46:
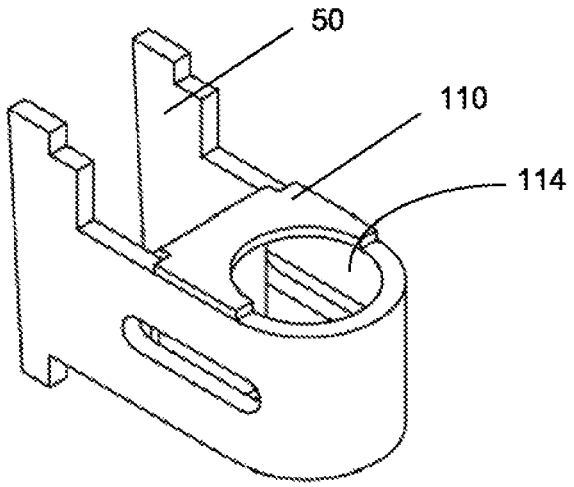
FIG. 46 illustrates a perspective view of a gate connecting bracket and a gate connecting adapter in an assembled position.

Referring to FIG. 45, an adapter 110 is shown that is used with a connecting bracket 50 to attach the top of a gate 60 to a post 30. This adapter 110 includes a lower end 111 and a larger upper end 112. The adapter is inserted into the bracket 50 from above, as shown in FIG. 46, such that the bracket 50 and adapter 110 together form a substantially round opening 114 through which a portion of the gate 60 fits, allowing the gate to pivot.

Figure 47A:
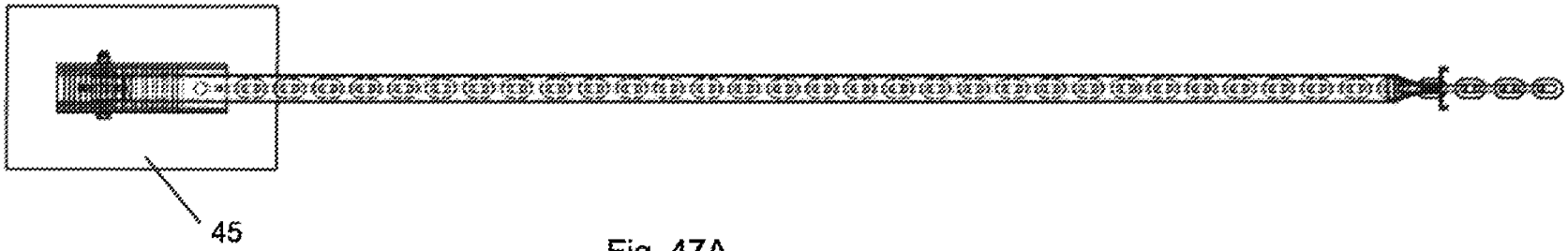
FIG. 47A illustrates a top view of a fence post brace.
Figure 47B:
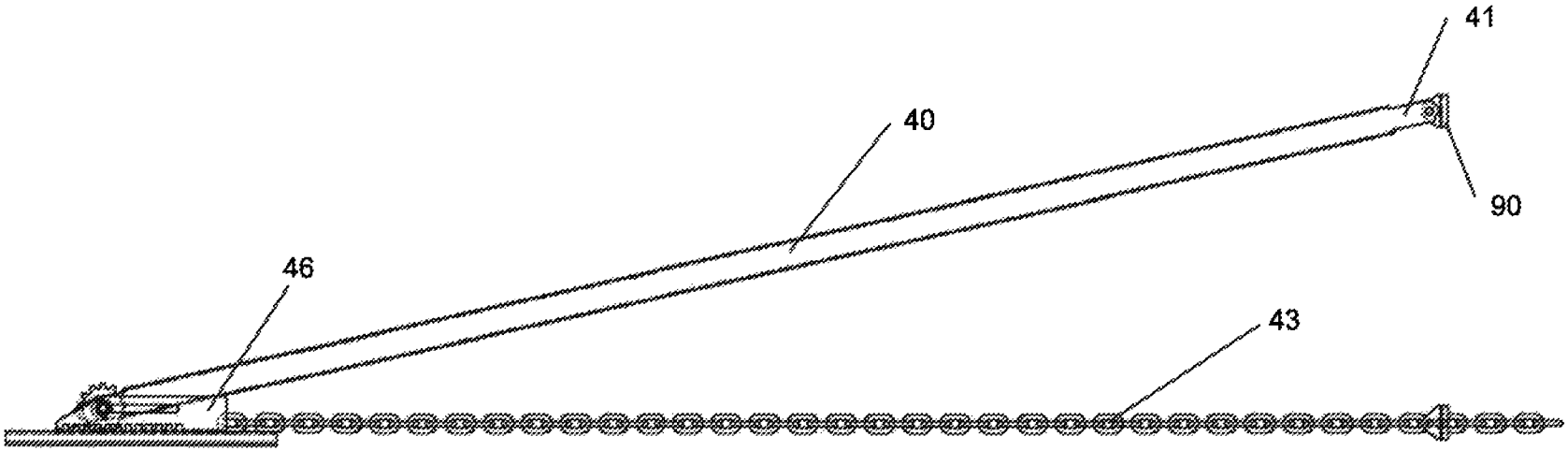
FIG. 47B illustrates a side view of a fence post brace.

FIGS. 47A and 47B illustrate a brace 40 with a first end 41 connectable to a post 30 via a bracket 90, and a second end 42 that abuts a substrate surface. In alternative embodiments the bracket 55 or bracket 95 may be used instead. The chain 43 is used to adjust the brace 40 and is also connectable to a post 30, typically by a bracket 90, one of the other brackets 55, 95, or using alternative attachment hole 44. While a chain 43 is used in the preferred embodiment, any other suitable tether may be used such as but not limited to a cable, wire, rope, link, cord, strap or rod.

The adjustable brace 40 has a number of advantages, such as not requiring entering the substrate at all and thereby further limiting interference with underground services already present, and being adjustable so that when a post moves over time the post can be corrected without requiring the traditional removal and complete reinstallation, or the addition of new braces.

Figure 48:
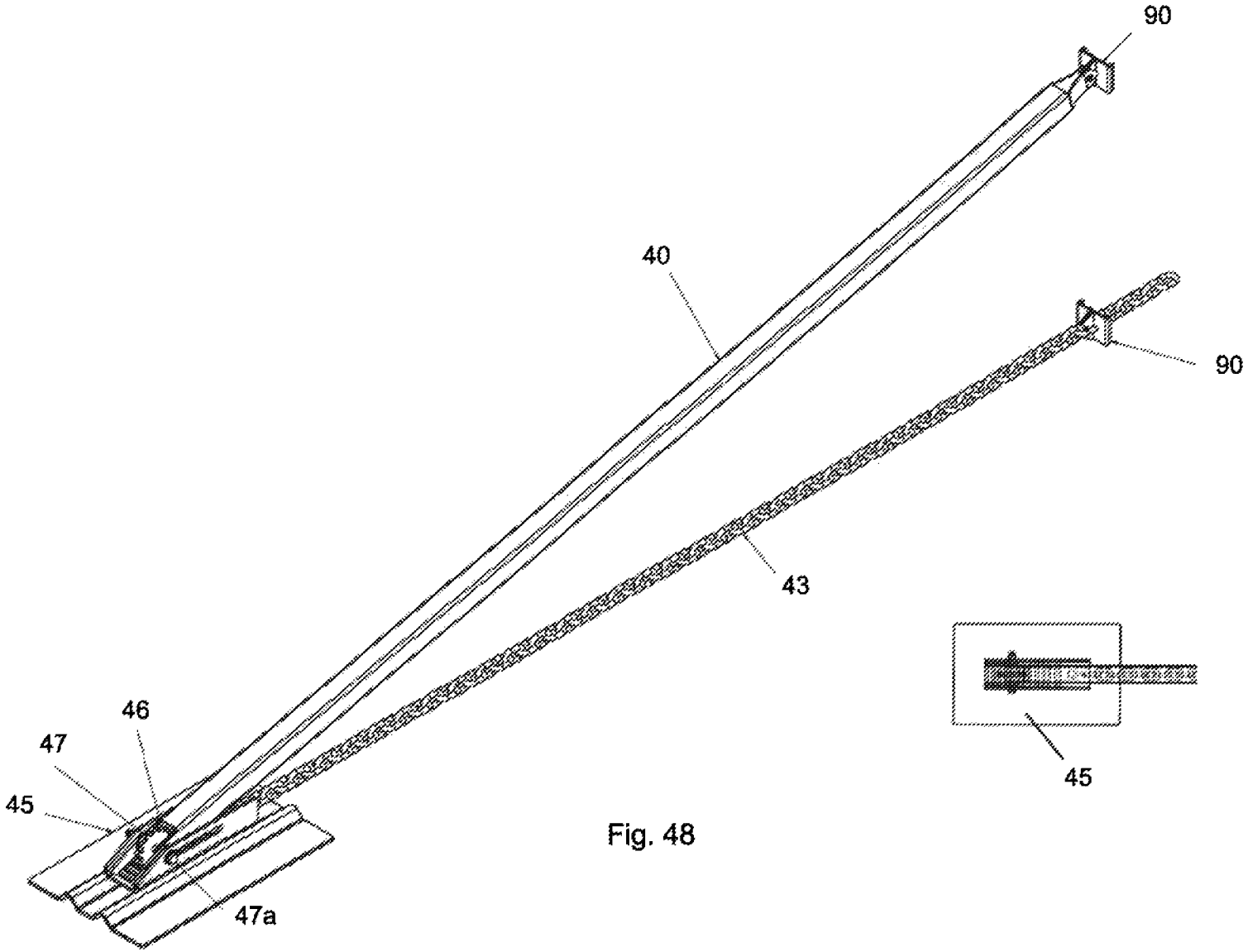
FIG. 48 illustrates a perspective view of a fence post brace alongside a top view of the adjustment portion.
Figure 49A:
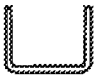
FIG. 49A illustrates end views of the brace end plate and guide prior to connecting during manufacture.
Figure 49A:
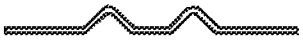
Figure 49B:
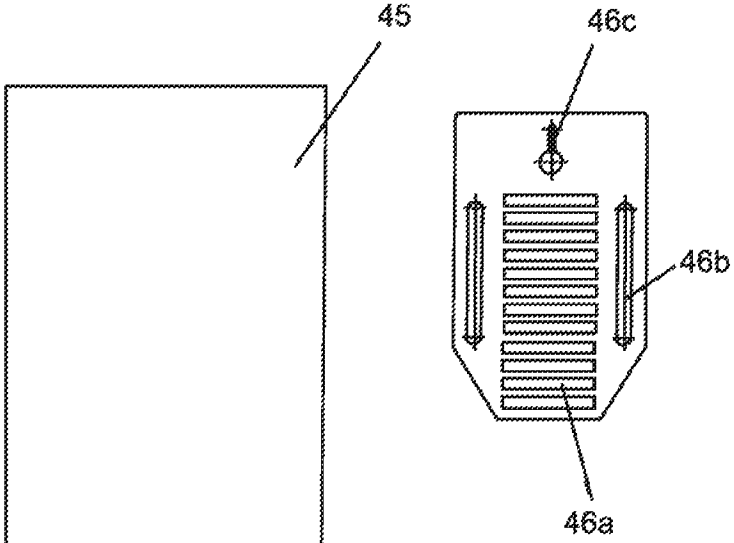
FIG. 49B illustrates top views of the brace end plate and guide prior to bending into shape and prior to connecting during manufacture.
Figure 49C:
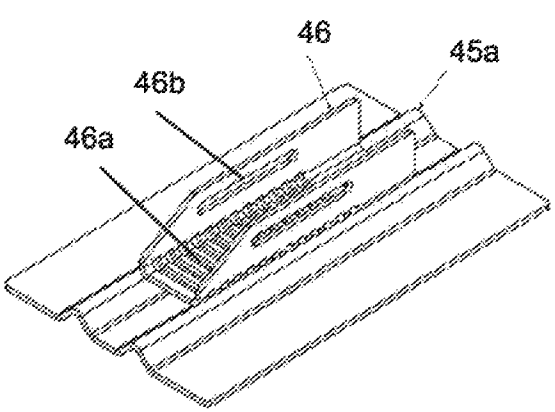
FIG. 49C illustrates perspective, top, side and end views of the plate component of the fence post brace with guide attached.
Figure 49C:
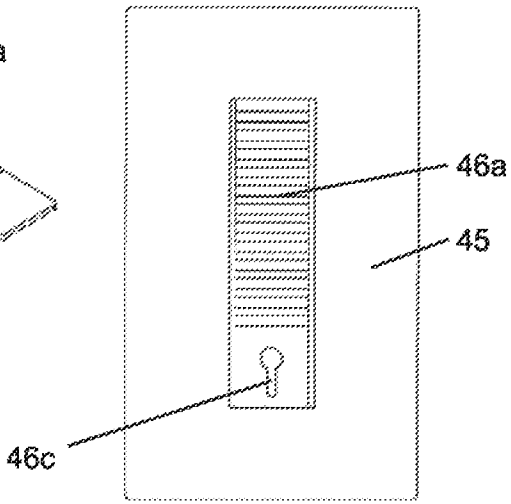
Figure 49C:
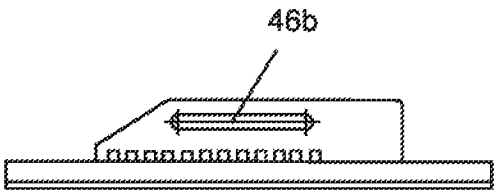
Figure 49C:
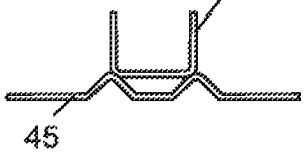

FIG. 48 illustrates the connection between the brace 40 and the chain 43 in more detail. In the embodiment shown a plate 45 abuts the substrate surface and has a ratchet mechanism attached for adjustment of the brace, which includes a guide 46. The chain 43 is attached to the plate 45 (via guide 46 in the present example), while the end of the brace 40 can be moved along the guide 46. The ratchet mechanism at the end of the brace 40 includes a wheel 47 and locking arm 49 which couple with slots 46*a* of the guide 46 (see FIGS. 49, 50 and 51 for more detail). A pin 47*a* passes through the centre of the wheel 47 and slides along the slot 46*b* of the guide 46.

Figure 50:
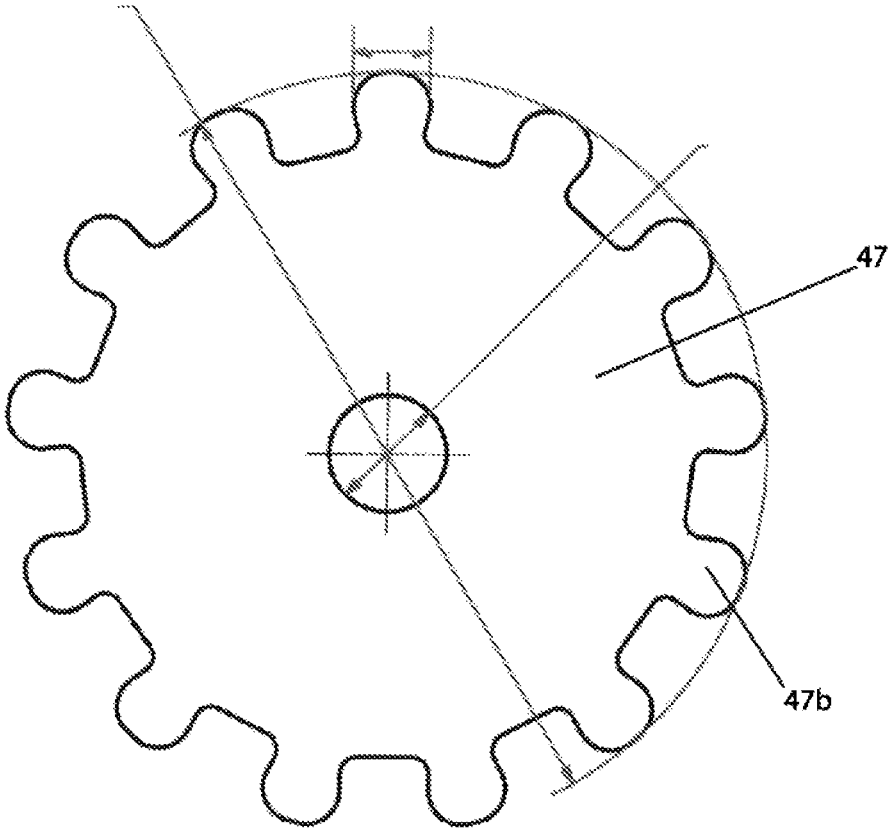
FIG. 50 illustrates a side view of a wheel that forms part of the ratchet adjustment mechanism of the fence post brace.
Figure 51:
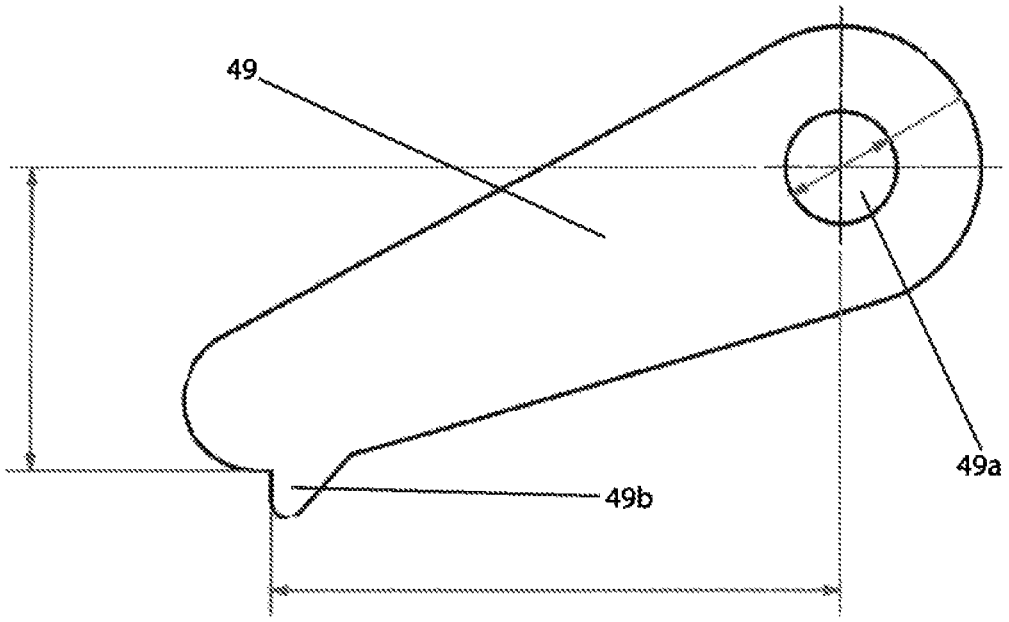
FIG. 51 illustrates a side view of an arm that forms part of the ratchet adjustment mechanism of the fence post brace.

Referring now in more detail to FIG. 49, a preferred embodiment of the plate 45 with guide 46 is shown. The plate 45 includes ridges 45*a* to which the guide 46 is attached, thereby providing space underneath the slots 46*a*. A hole 46*c* is also provided for attaching the chain 43. FIG. 50 shows the wheel 47 with teeth 47*b* that couple with and protrude into the space underneath the slots 46*a*. The locking arm 49 also attaches to the pin 47*a* and locks the brace 40 after the chain 43 has been tensioned. The locking arm works by the tab 49*b* coupling with the slots 46*a*, thereby allowing the end of the brace 40 to be moved in a direction that tensions the chain 43 but then falling into a slot 46*a* and preventing movement back in the other direction.

Figure 52:
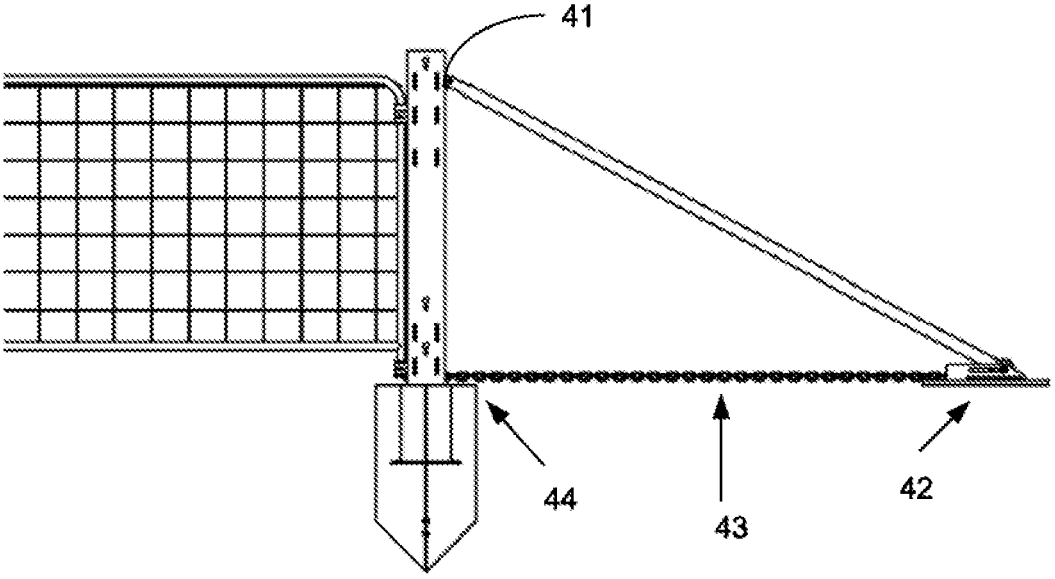
FIG. 52 illustrates an adjustable brace connected to an installed post.
Figure 53:
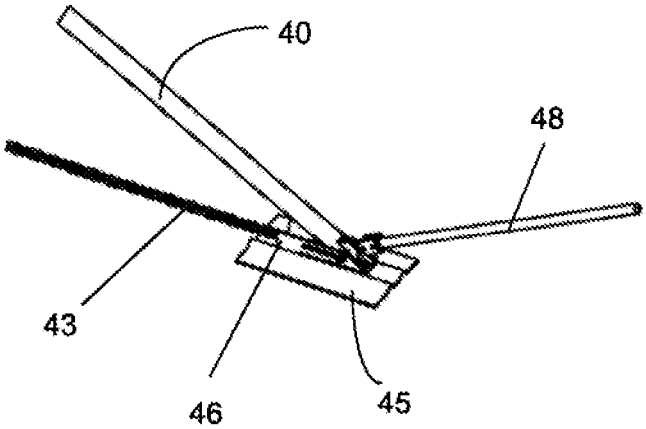
FIG. 53 illustrates the adjusting mechanism of the adjustable brace and a tool used to move the adjusting mechanism.
Figure 54:
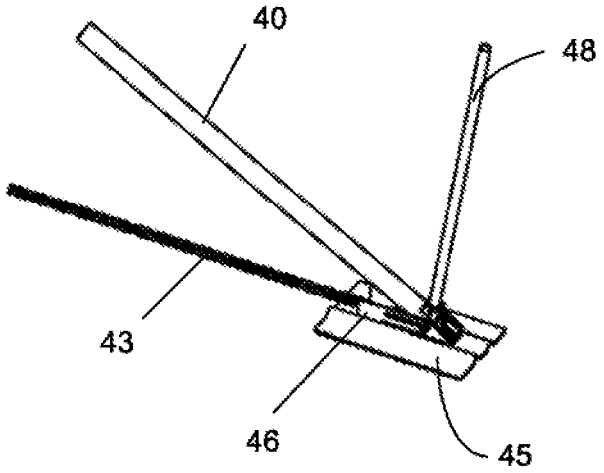
FIG. 54 illustrates the adjusting mechanism being moved using a tool.

Referring to FIG. 52, the brace 40 is shown attached to a post 30. FIG. 53 shows the brace prior to being adjusted using a brace adjusting tool 48 and in FIG. 54 the tool 48 is in use coupled to the end of the brace 40.

Figure 57:
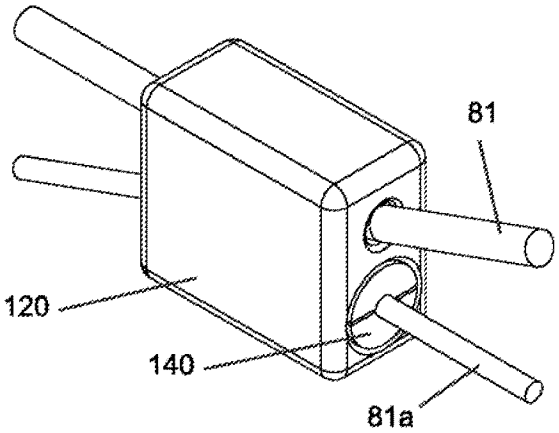
FIG. 57 illustrates a perspective view of a wire connector.
Figure 55A:
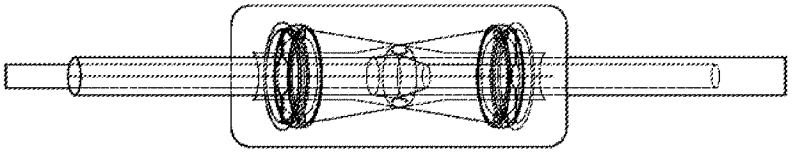
FIG. 55A illustrates a top view of a wire connector.
Figure 55B:
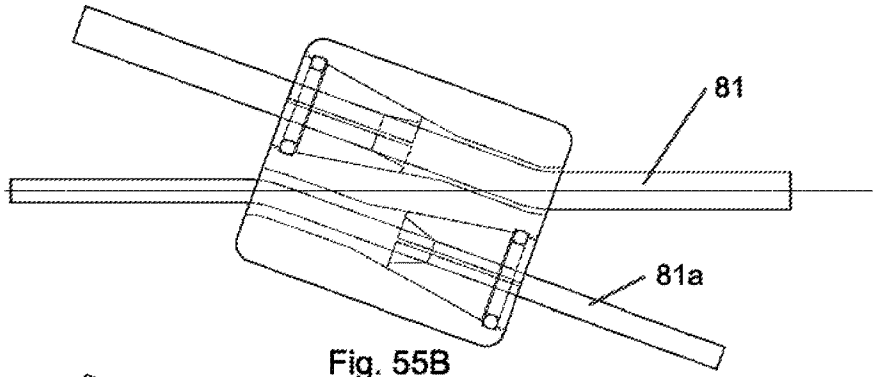
FIG. 55B illustrates a side view of a wire connector.
Figure 56:
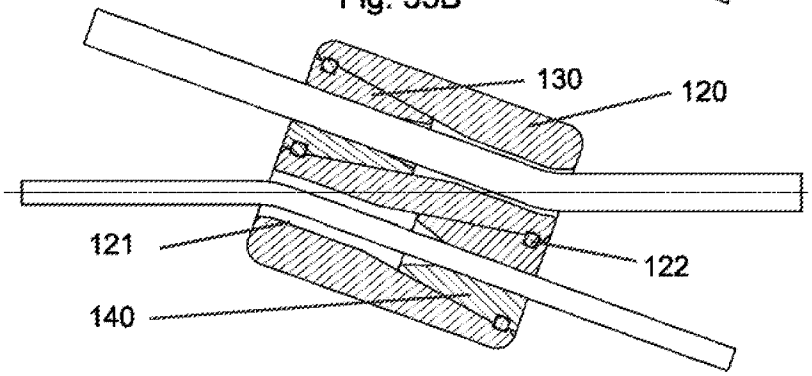
FIG. 56 illustrates a side view cross section of a wire connector.
Figure 55C:
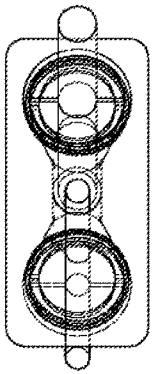
FIG. 55C illustrates an end view of a wire connector.

Referring to FIG. 55A through to FIG. 57, a wire connector is shown that includes a main body 120 through which wires 81 are passed. Two wedges 130 are used to grip the wire and are locked in place using screws 122. Alternatively, in the case of a narrow wire 81*a* a larger wedge 140 may be used. The openings of the body 120 are shaped such that as the wedges 130 are inserted they are forced together, compressing the wire 81 and holding it in place. The wire 81 on the opposite side of the body 120 to the wedges 130 is placed in tension, thereby causing the tension to help maintain the wedges 130 inside the body 120 and the tension on the wire 81 acts to force the wedges 130 further into the body 120 as the tension is increased, further compressing the wire 81 and strengthening the hold on the wire 81.

The wedges 140 work in the same way on the wire 81*a* as described above for wedges 130 and wire 81. The bores through the body 120 may be the same size, allowing for any sized wire to be used with an appropriate choice of wedge size.

Figure 59:
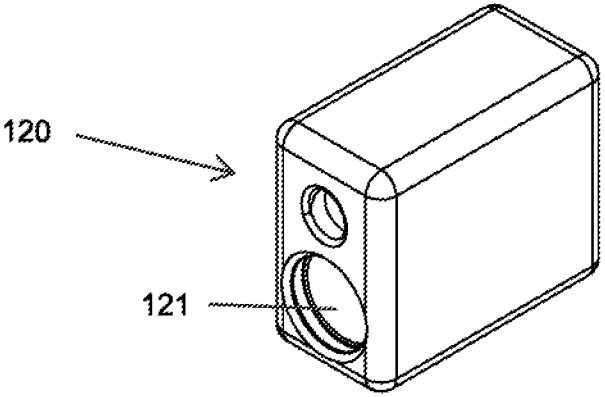
FIG. 59 illustrates a perspective view of a body of a wire connector.
Figure 58:
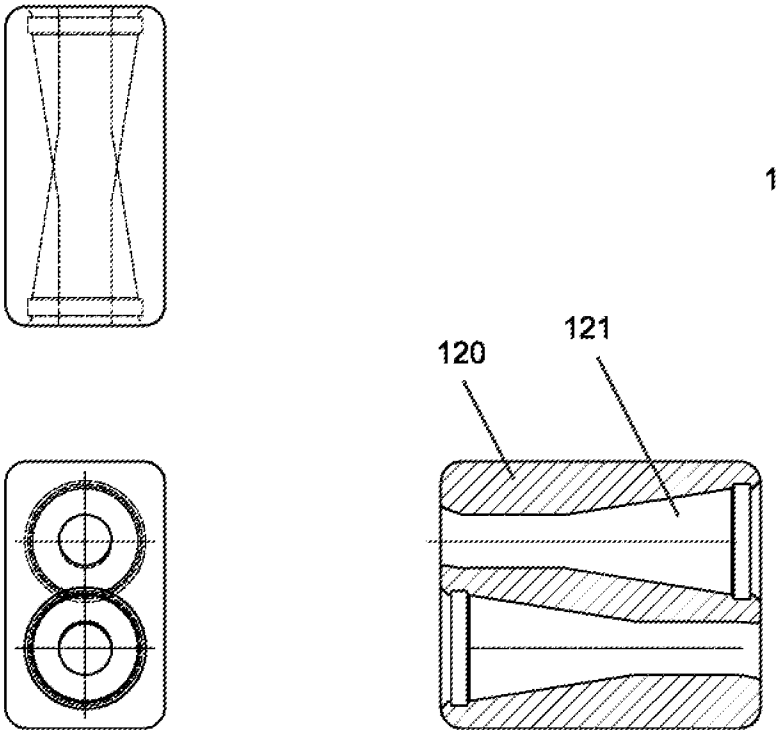
FIG. 58 illustrates a top, end and side cross section view of a body of a wire connector.
Figure 60:
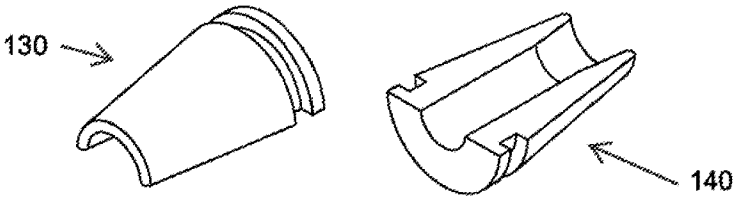
FIG. 60 illustrates a perspective view of wedges of a wire connector.
Figure 61A:
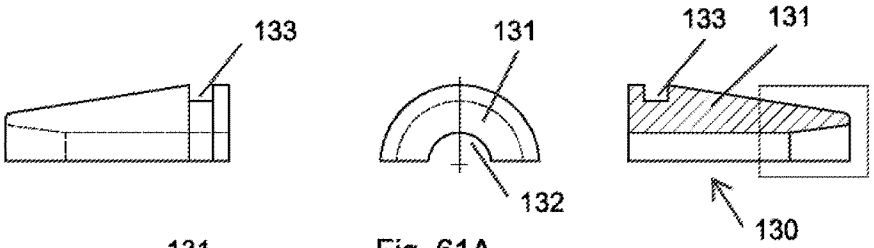
FIG. 61A illustrates a side, end and side cross section view of a first wedge of a wire connector.
Figure 61B:
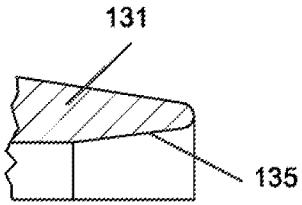
FIG. 61B illustrates an enlarged view of the tip of the wedge from FIG. 61A.
Figure 62A:
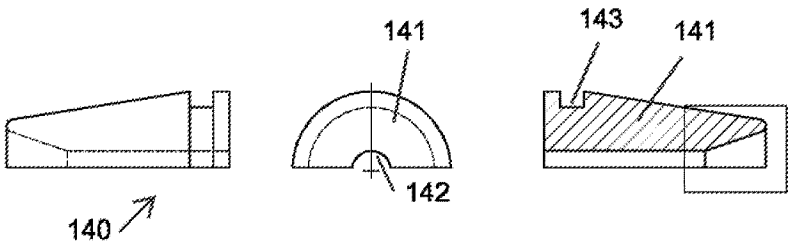
FIG. 62A illustrates a side, end and side cross section view of a second wedge of a wire connector.
Figure 62B:
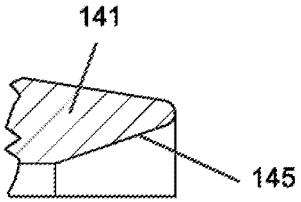
FIG. 62B illustrates an enlarged view of the tip of the wedge from FIG. 62A.

FIGS. 58 and 59 show the body 120 separate from the wires and wedges. FIG. 60 shows two wedges, while FIG. 61 shows the smaller of the wedges 130. The wedge includes a body 131 with a central cutout 132 that forms a hole when a pair of wedges are placed together. A groove 133 is provided through which the screws 122 pass and lock the wedge into the body 120. A tapered portion 135 is provided to make insertion of the wedge 130 into the body 120 easier. FIG. 62 shows the larger wedge 140 that includes similar features of body 141, central cutout 142, groove 143 and taper 145.

FIGS. 58 and 59 show the connecting block on its own, while FIGS. 60, 61 and 62 show the wedges on their own.

Figure 63A:
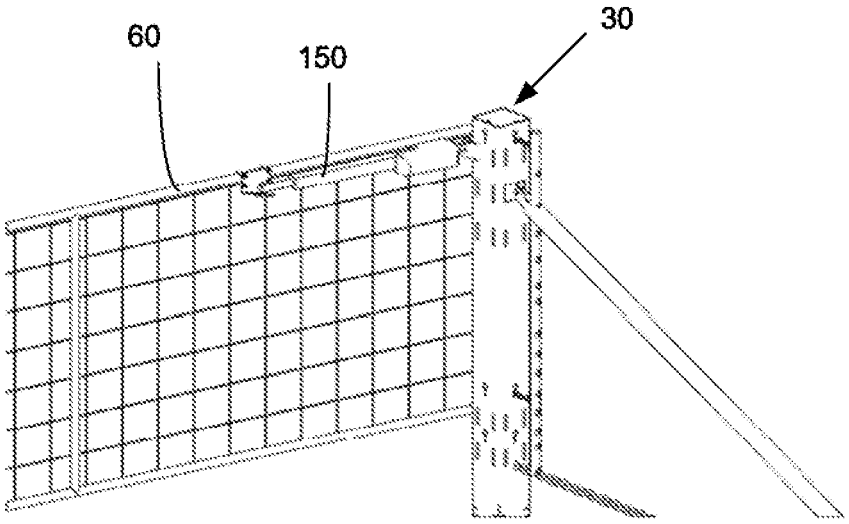
FIGS. 63A to 63C illustrate an automated gate opening and closing system.
Figure 63B:
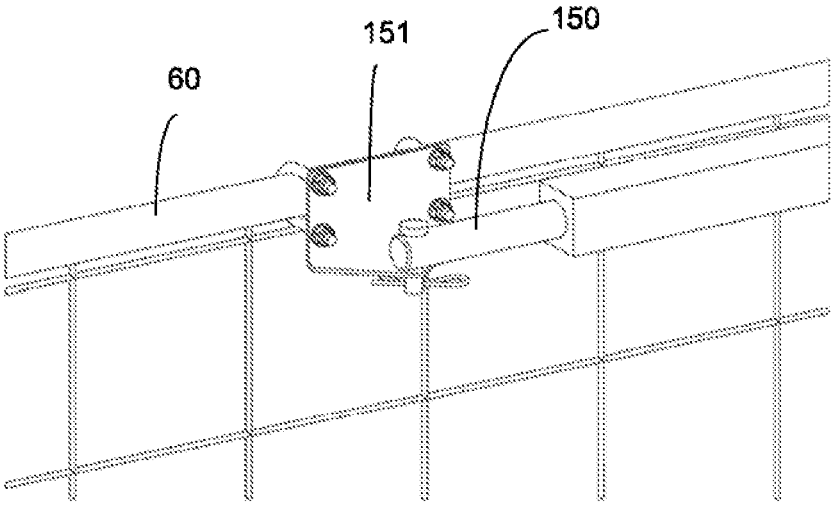
Figure 63C:
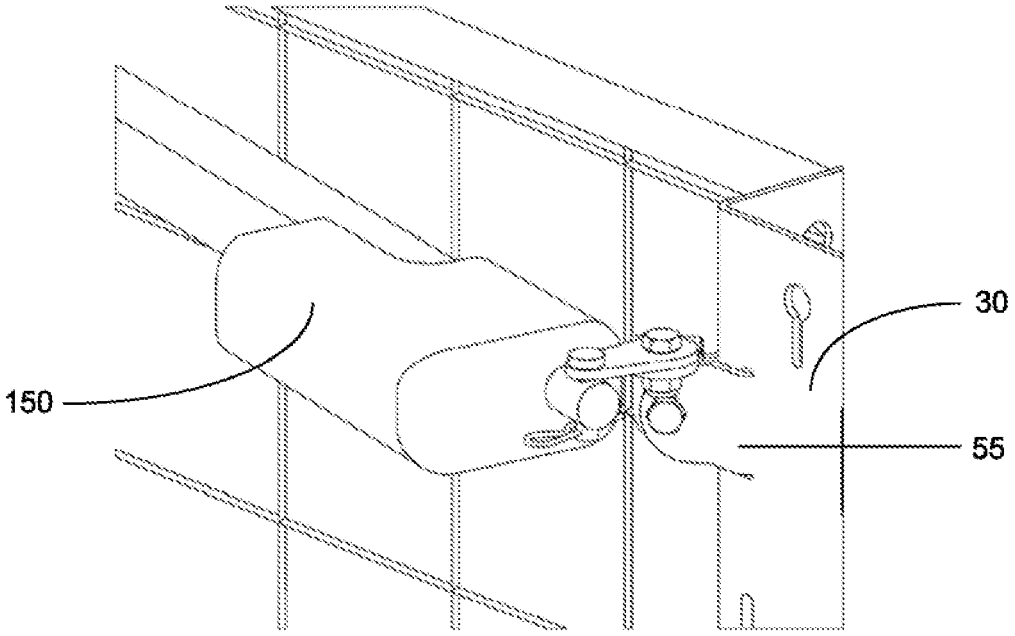

FIG. 63A shows a system for opening and closing a gate 60. This system uses an extendable arm 150, which in this example is a hydraulic piston operated by an electric motor. The extendable arm 150 is attached to the gate 60 at one end and the post 30 at the other end. The attachment to the post may be using any of the attachments as described previously, such as connecting bracket 55. FIG. 63B shows the attachment to the gate 60 in more detail, including bracket 151, while FIG. 63C shows the attachment to the post 30 in more detail. This system may be connected to mains power, battery, solar or any other suitable power source. It could also include sensors to automatically open or close the gate, and may preferably be remotely controlled.

Figures 64, 65, 66:
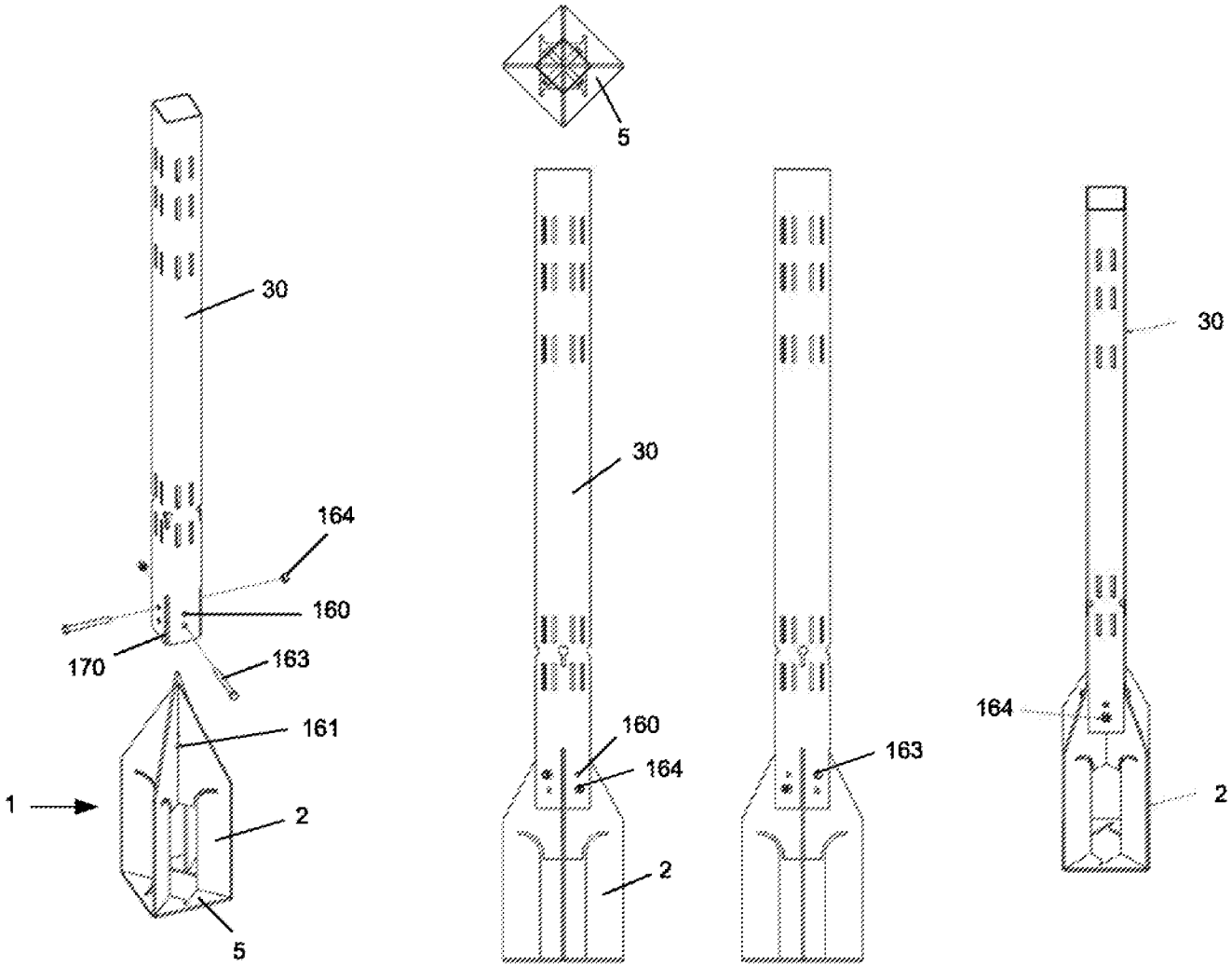
FIG. 64 illustrates an exploded perspective view of a post and an inverted post mount.
FIG. 65 illustrates front, side and top views of a post connected to an inverted post mount.
FIG. 66 illustrates a perspective view of a post connected to an inverted post mount.

Referring to FIGS. 64 to 66, an alternative method of connecting the post 30 to the post mount 1 is shown for situations where a permanent post 30 is desired. Rather than use an alternative form of post mount 70, the preferred embodiment of the post mount 1 can be used by inverting it, or turning it upside down. To secure the post 30 to the mount 1, pairs of holes 160 are provided on the post 30 that correspond to holes 161 in the mount 1. These are secured to one another using bolts 163 and nuts 164, or alternatively some other suitable fastener. The post 30 is also provided with slots 170 so that the post 30 can slide over the body 2 of the mount 1. Pairs of holes 160 are provided on the post 30 even though they are not all used so that the post 30 can be placed onto the mount 1 in any orientation, and appropriate holes 160 can simply be chosen.

Figures 67, 68, 69:
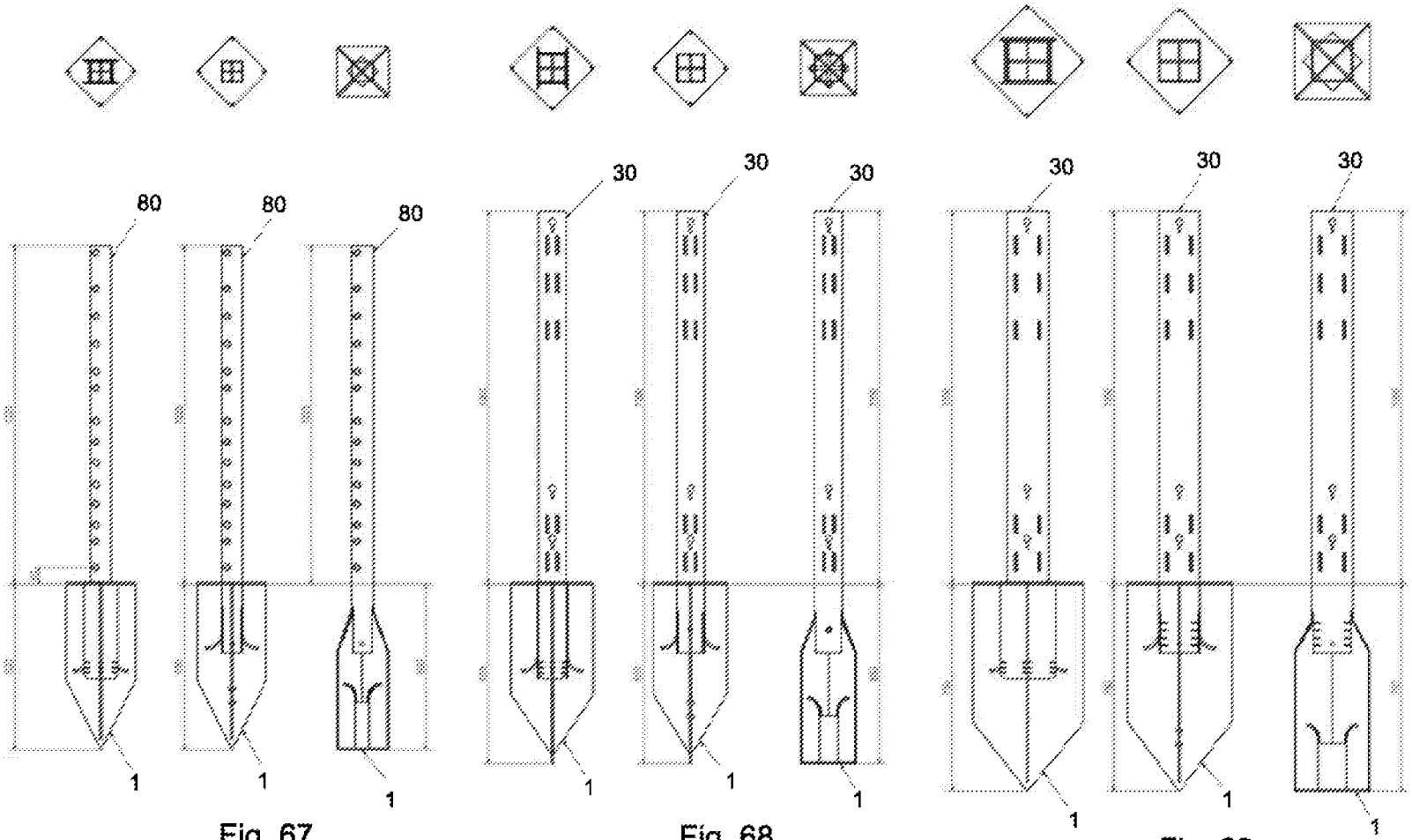
FIGS. 67 to 69 illustrate various embodiments of fence posts connected to various embodiments of post mounts.

Referring to FIGS. 67 to 69, it becomes apparent that the invention will typically be made in various sizes and configurations to suit different purposes. For example, different types of posts 30, 80, different sizes and shapes of mounts 1, and different methods of mounting, either in a removable manner or permanently by inverting the mount 1 as described above.

Figures 70, 71, 72:
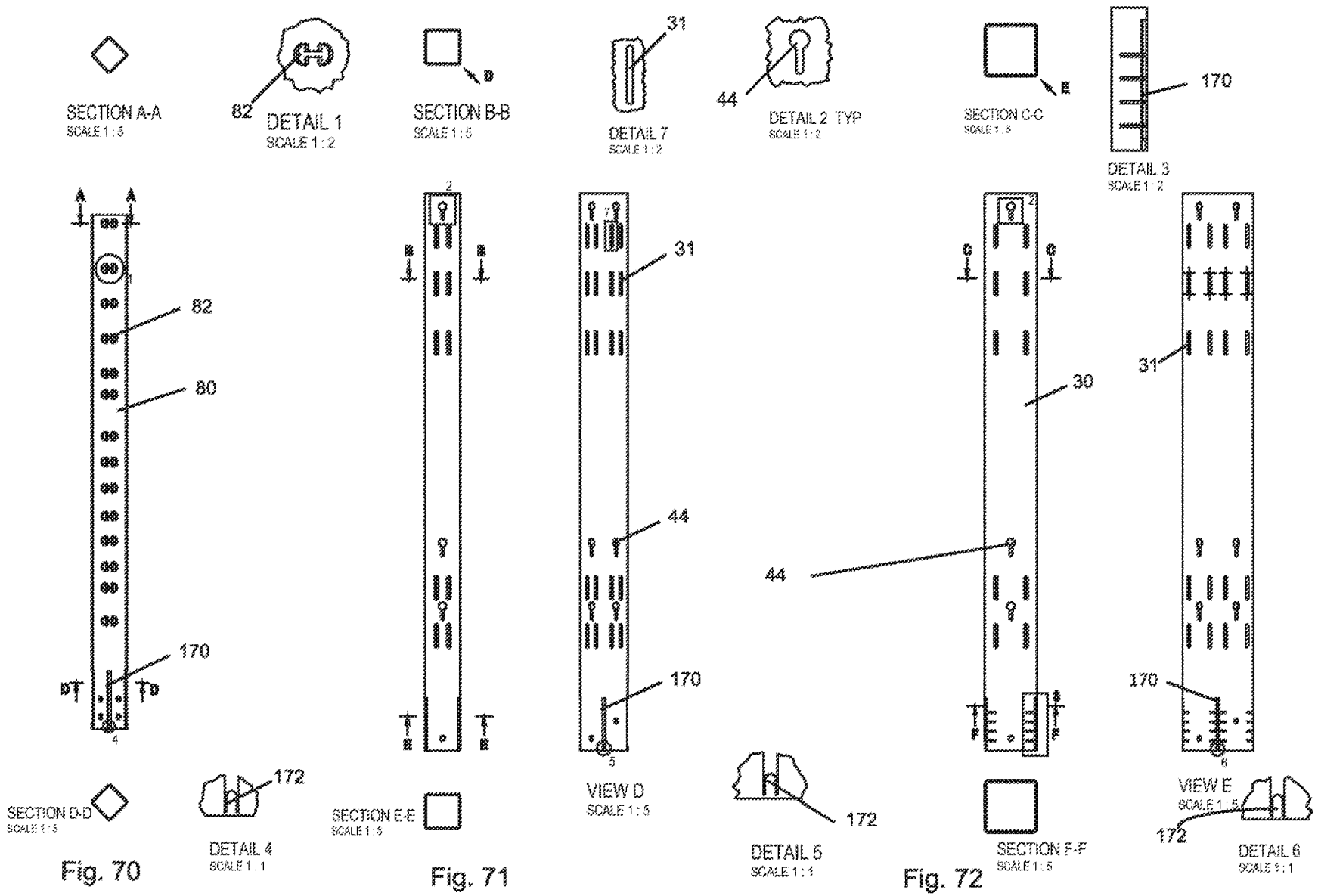
FIG. 70 illustrates a side, top and bottom view of a post.
FIG. 71 illustrates front, side, top and bottom views of a post.
FIG. 72 illustrates front, side, top and bottom views of a post.

Referring to FIG. 70, an embodiment of an alternative post 80 is shown. Similarly, FIGS. 71 and 72 also show posts 30. The embodiments of the posts 30, 80 shown in these figures all include slots 170 towards one end to allow them to be connected to the mount 1 when the mount 1 is in an inverted position. The enlarged portions of these figures that show the slots 170 in more detail show that at the end of each slot there is a break away tab 172.

The tab 172 provides support to the post 30 (80) to ensure that it stays in the correct shape during manufacture. If the post 30 (80) is used with the mount 1 so that it can be removed, the tab 172 can stay in place, providing support to the shape of the post throughout its life. When the post 30 (80) is used with the mount inverted, however, the tabs 172 are simply broken off as the post 30 (80) is forced onto the mount 1.

The posts 30 (80) shown in FIGS. 70 to 72 can also be installed in a permanent manner using another method. The mount 1 may be driven into the substrate as described previously, however without an insert 3 present. The post 30 (80) itself can then be forced into the mount 1 and take a similar function to what the insert 3 had previously. That is, the post 30 (80) is driven into the mount 1 so that it is forced along the slots 4, guiding the end of the post 30 (80) outwardly such that it is deformed. As this happens the tabs 172 break off, allowing the end of the post 30 (80) to splay. The deformed end of the post 30 (80) fixes the mount 1 into the substrate and also fixes the post 30 (80) to the mount 1.

Figure 74:
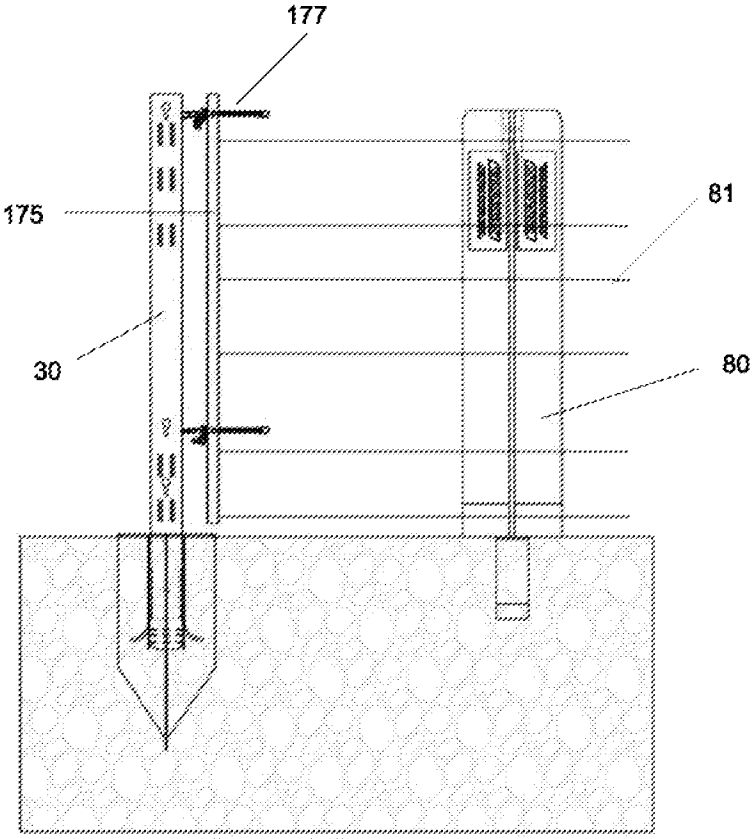
FIG. 74 illustrates a side view of another part of a fence assembly.
Figure 73:
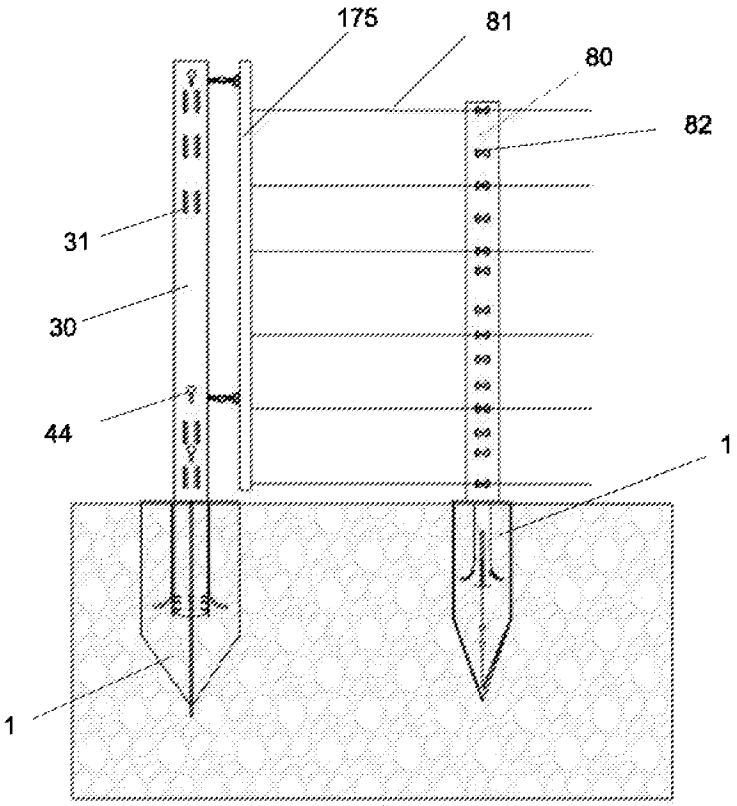
FIG. 73 illustrates a side view of part of a fence assembly.
Figure 76:
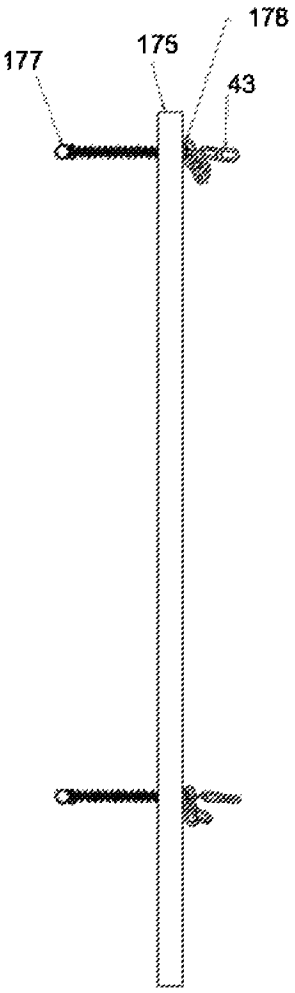
FIG. 76 illustrates another embodiment of a mounting post.
Figure 75:
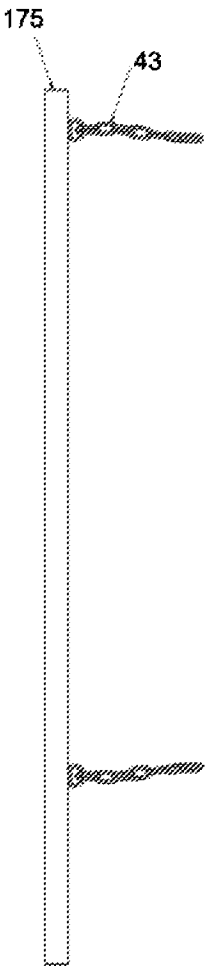
FIG. 75 illustrates a side view of a wire mounting post.
Figure 77:
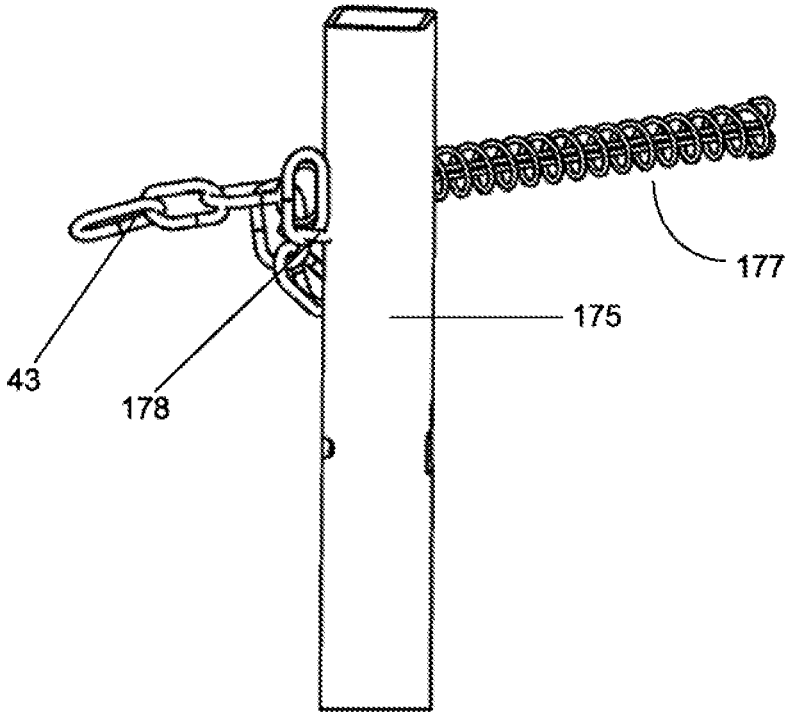
FIG. 77 illustrates a perspective view of a connection of a spring to a mounting post using a spring with the spring in an extended configuration.
Figure 78:
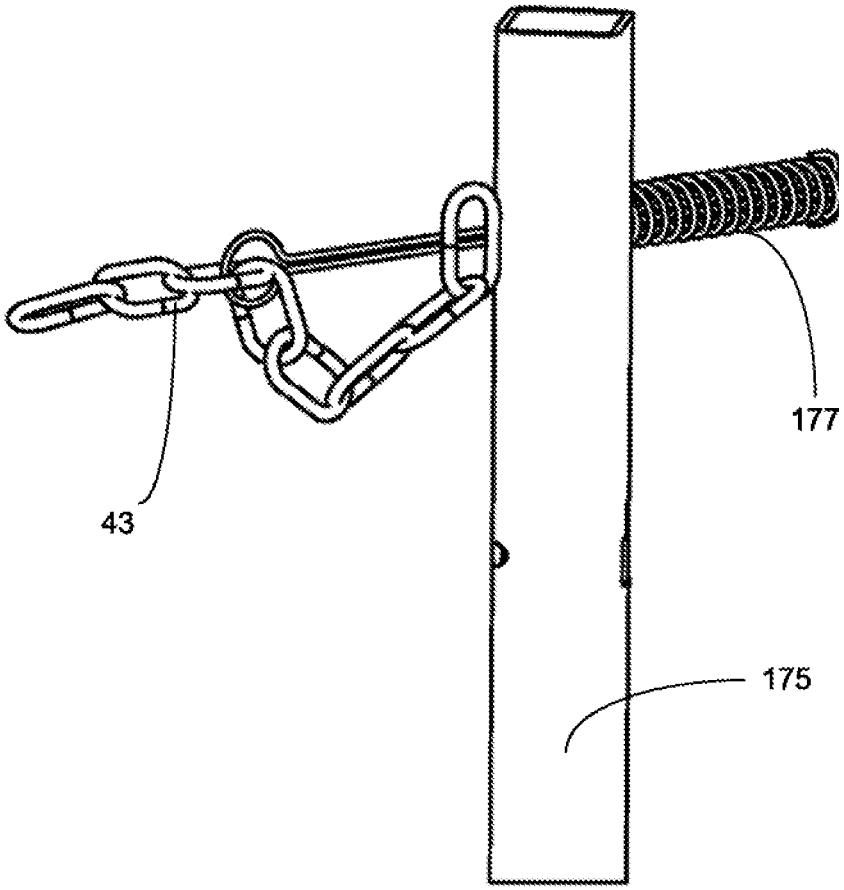
FIG. 78 illustrates a perspective view the connection of FIG. 77 where the spring is in a compressed configuration.
Figure 79:
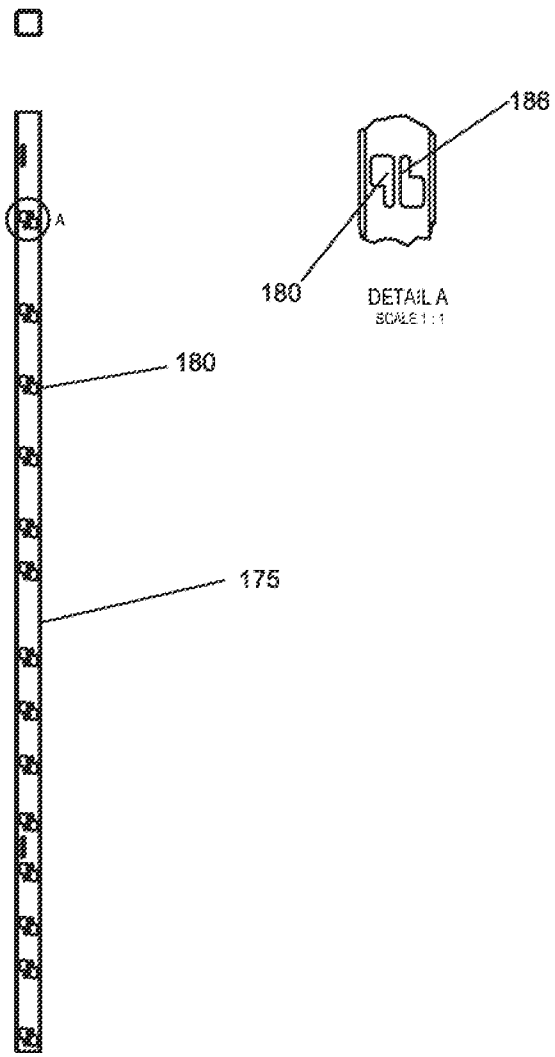
FIG. 79 illustrates a top view, side view and enlarged portion of the side view of a mounting post.
Figure 80:
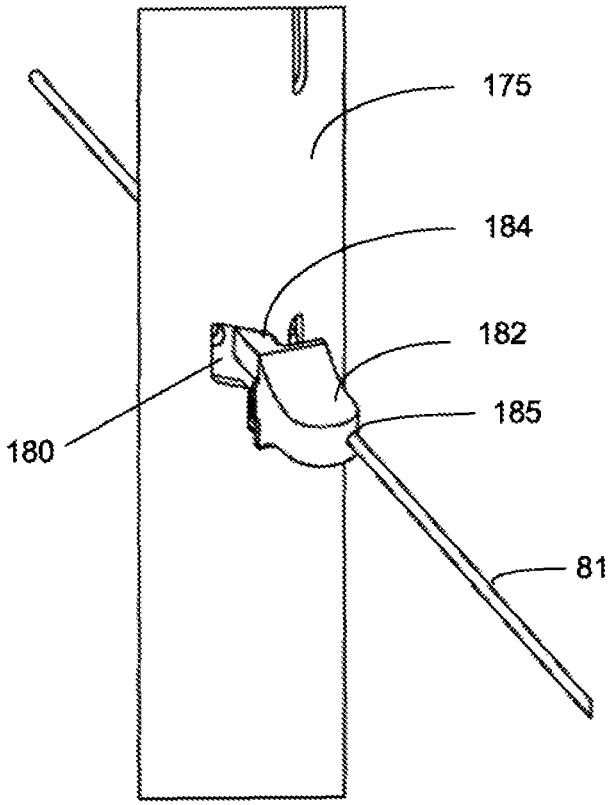
FIG. 80 illustrates a perspective view of a wire connected to a mounting post using a connector.
Figure 81:
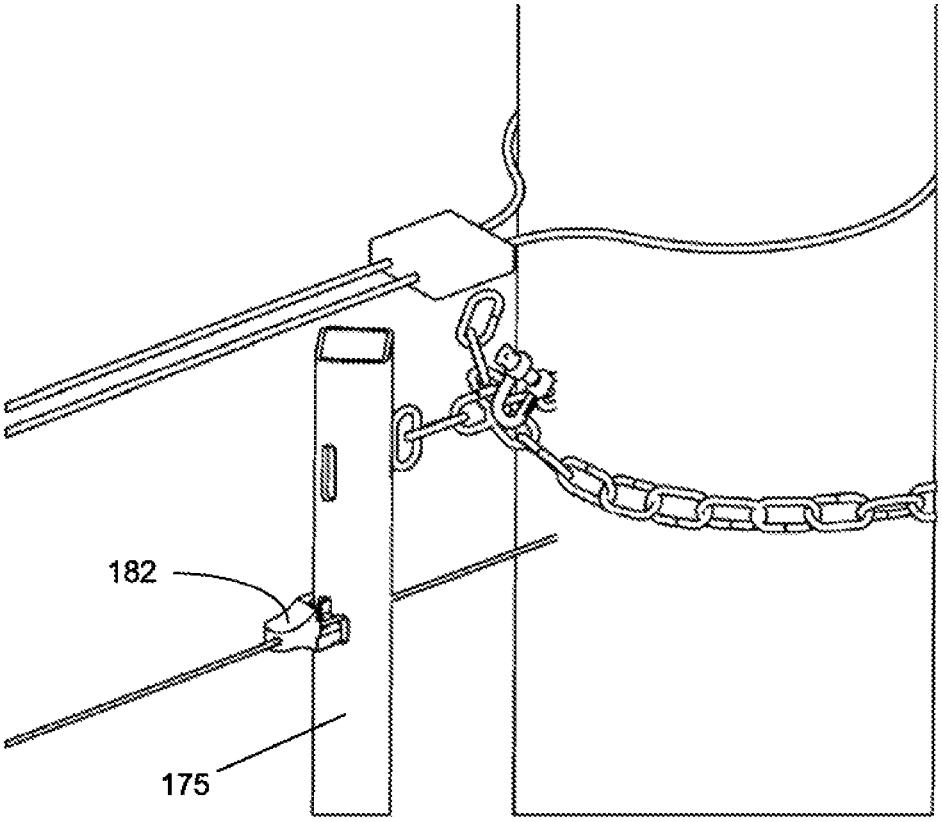
FIG. 81 illustrates a perspective view of a wire connected to a mounting post using a connector.

Referring to FIGS. 73 and 74, embodiments of a fence assembly are shown, including mounts 1 installed in a substrate, posts 30, 80 fitted to the mounts 1 and wires attached to one post 30 using a vertical member 175 or wire mounting post. FIGS. 75 and 76 show the mounting post 175 in more detail. As described previously, the mounting post 175 has wires 81 attached and connects to the post 30 using a chain 43 fitted into holes 44. This attachment method is advantageous because it allows for the wires 81 to be easily disconnected and reconnected, for example for removing the post 30 as also described previously. It also allows for tensioning of the fence by connecting the mounting post 175 using a different link of the chain 43.

Referring now to FIGS. 74 and 76 to 78, the embodiment of the invention shown includes a floating mounting post 175. This mounting post 175 is still connected to the post 30 using a chain 43, however the chain 43 attaches to the mounting post 175 directly but also using a spring 177. Tension on the wires 81 causes the spring 177 to be compressed, and if the spring 177 compresses up to a certain point the chain 43 being attached to the mounting post 175 at location 178 prevents any further compression of the spring 177. This system is also useful to aid in connecting and disconnecting the mounting post 175 to the post 30, as the springs 177 can be compressed to provide slack in the chain 43 to allow easier removal from the post 30.

Referring now to FIGS. 79 to 82, an embodiment of a system of attaching the wire 81 to the mounting post 175 is shown. The attachment uses a pair of holes 180 in the mounting post 175 and a connector 182. The connector 182 includes a means for attaching the wire 81 and a pair of hooks 184.

The wire 81 attaches to the connector 182 by being fed into a hole 185 where it is retained using an internal mechanism (not shown). This internal mechanism includes a tapered hole, enlarging in the direction moving away from the hole 185 towards the hooks 184. This hole 185 may continue through the body of the connector 182 such that there is an opening on the opposite side, such as between the hooks 184. A gripping device is also located internally, which may be in the form of a wedge, cylinder or other suitable shape.

The gripping device is configured such that the wire can be inserted into the connector 182, during which time the wire pushes the gripping device towards the larger end of the tapered passage. As an attempt is then made to pull the wire out of the connector 182 the gripping device is pulled towards the smaller end of the tapered passage, thereby locking the wire in place. This process may be assisted by a biasing means such as a spring that urges the gripping device towards the smaller end of the tapered passage.

In an alternative embodiment, a screw may be included that can manually force the gripping device towards the small end of the tapered passage to manually lock the wire 81 in the connector 182. In yet another embodiment, a wire locking system similar to that described in relation to FIGS. 55A to 57 may be used. In yet another embodiment, the wire 81 may be connected to the connector 182 using any other known method, such as a standard clamp or simply tying the wire 81 to the connector 182.

Once the wire 81 is fixed in the connector 182, the connector 182 can then be attached to the mounting post 175. The hooks 184 of the connector 182 both protrude from the body of the connector 182 in the same direction, but the hook portions are oriented at 180° to one another. Stated another way, the hooks are substantially opposed to one another.

To attach to the mounting post 175, the connector 182 is positioned so that one hook 184 is inserted into each of the large ends of the pair of holes 180. The connector 182 is then rotated such that the hooks 184 each move behind the central member 186 that separates the holes 180 from each other. A small movement back in the outward direction, such as through tension in the wires 81, ensures the hooks 184 latch securely to the post 175.

The connector 182 can be removed from the mounting post 175 using the reverse of the method described above. In use, however, tension on the wire 81 ensures that the hooks 184 remain securely latched behind the central member 186. Due to the shape of the hooks 184, the reverse rotation of the connector 182 cannot happen without a reduction in this tension, as the ends of the hooks 184 extend at least partially back out of the opposite hole 180.

In alternative embodiments of the invention, the system described above can be used to connect a wire 81 directly to a post 30, 80, without the use of a mounting post 175.

Many modifications will be apparent to those skilled in the art without departing from the scope of the present invention.

The claims defining the invention are as follows:

1. A post mount, adapted to be installed in a substrate and releasably receive a post therein, the post mount including:

a body which is adapted to be driven into the substrate, the body including a flange which is adapted to abut a surface of the substrate; and an insert, including a plurality of walls, each wall including a deforming portion, the insert adapted to be received by the body and adapted to cooperate with the body;

wherein:

the body includes a plurality of plate members depending from the flange, each plate member including a guide in the shape of an outwardly curved slot having a closed lower end; the deforming portions of the insert walls being configured to cooperate within a respective curved slot in the body to be at least partially deformed therein in an outwardly displaced manner such that the post mount can be anchored to the substrate surface, the closed ends of the slots preventing the deforming portions of the insert from extending beyond an outer edge of the body.

2. The post mount according to claim 1, including an opening at an upper end of the post mount adapted to receive a post therein.

3. The post mount according to claim 1, wherein a lower end of the body is shaped to facilitate driving the post mount into the substrate.

4. The post mount according to claim 1, wherein an upper end of the post mount is adapted to receive a tool, to drive the post mount into the substrate.

5. The post mount according to claim 1, wherein an upper end of the post mount is adapted to receive a tool to drive the insert to cause the insert to be deformed and thereby anchor the post mount to the substrate.

6. A post assembly, including:

a post mount, according to claim 1, adapted to be installed in a substrate; and a post, adapted to be releasably received in the post mount.

7. A fence, including a plurality of post assemblies according to claim 6 and fencing material spanning each of the post assemblies.

* * * * *